US009322266B2

(12) United States Patent
Glattetre et al.

(10) Patent No.: US 9,322,266 B2
(45) Date of Patent: Apr. 26, 2016

(54) FORMATION SAMPLING

(75) Inventors: Geir Thomas Glattetre, Boenes (NO); Jan Erik Tvedten, Lysekloster (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 901 days.

(21) Appl. No.: 13/520,565

(22) PCT Filed: Dec. 22, 2010

(86) PCT No.: PCT/IB2010/003453

§ 371 (c)(1), (2), (4) Date: Oct. 10, 2012

(87) PCT Pub. No.: WO2011/080586

PCT Pub. Date: Jul. 7, 2011

(65) Prior Publication Data

US 2013/0025855 A1 Jan. 31, 2013

Related U.S. Application Data

(60) Provisional application No. 61/291,967, filed on Jan. 4, 2010, provisional application No. 61/293,252, filed on Jan. 8, 2010.

(51) Int. Cl.
*E21B 49/08* (2006.01)
*E21B 49/10* (2006.01)

(52) U.S. Cl.
CPC ..... *E21B 49/08* (2013.01); *E21B 49/10* (2013.01)

(58) Field of Classification Search
CPC ..... E21B 49/08; E21B 49/081; E21B 49/082; E21B 49/10
See application file for complete search history.

(56) References Cited

U.S. PATENT DOCUMENTS

| | | | | |
|---|---|---|---|---|
| 4,856,585 | A | | 8/1989 | White et al. |
| 4,860,581 | A | | 8/1989 | Zimmerman et al. |
| 4,936,139 | A | | 6/1990 | Zimmerman et al. |
| 5,101,907 | A | * | 4/1992 | Schultz et al. ..... 166/386 |
| 5,230,244 | A | * | 7/1993 | Gilbert ..... 73/152.17 |
| 5,233,866 | A | | 8/1993 | Desbrandes |
| 5,303,775 | A | | 4/1994 | Michaels et al. |
| 5,803,186 | A | | 9/1998 | Berger et al. |
| 6,230,557 | B1 | | 5/2001 | Ciglenec et al. |
| 6,301,959 | B1 | | 10/2001 | Hrametz et al. |
| 6,585,045 | B2 | | 7/2003 | Lee et al. |

(Continued)

OTHER PUBLICATIONS

International Search Report & Written Opinion issued in PCT/IB2010/003453 on Aug. 8, 2011; 13 pages.

*Primary Examiner* — Cathleen Hutchins
(74) *Attorney, Agent, or Firm* — Kenneth L. Kincaid

(57) ABSTRACT

A sampling apparatus, comprising a primary flowline, a secondary flowline, a dump flowline not provided downstream of the secondary flowline, and a relief valve provided in the dump flowline, may be disposed in a wellbore penetrating a subterranean formation. A method of use of the sampling apparatus may comprise flowing fluid from the subterranean formation and into the primary flowline; diverting fluid from the primary flowline to a sample chamber through the secondary flowline; diverting fluid from the primary flowline to the wellbore through the dump flowline; and controlling the pressure in the sample chamber using the relief valve. The sampling apparatus may be used to terminate storage of a fluid sample in a sample chamber while continuing to pump fluid from the formation.

16 Claims, 13 Drawing Sheets

(56) References Cited

U.S. PATENT DOCUMENTS

| | | | | |
|---|---|---|---|---|
| 6,609,568 | B2 | 8/2003 | Krueger et al. | |
| 6,659,177 | B2 | 12/2003 | Bolze et al. | |
| 6,688,390 | B2 | 2/2004 | Bolze et al. | |
| 6,719,049 | B2 | 4/2004 | Sherwood et al. | |
| 6,837,314 | B2 | 1/2005 | Krueger et al. | |
| 6,964,301 | B2 | 11/2005 | Hill et al. | |
| 6,986,282 | B2 | 1/2006 | Ciglenec et al. | |
| 7,114,562 | B2 | 10/2006 | Fisseler et al. | |
| 7,124,819 | B2 | 10/2006 | Ciglenec et al. | |
| 7,243,536 | B2 | 7/2007 | Bolze et al. | |
| 7,367,394 | B2 | 5/2008 | Villareal et al. | |
| 7,543,659 | B2 | 6/2009 | Partouche et al. | |
| 7,594,541 | B2 | 9/2009 | Ciglenec et al. | |
| 7,677,307 | B2 | 3/2010 | Vasques et al. | |
| 7,845,405 | B2 | 12/2010 | Villareal et al. | |
| 8,056,625 | B2 | 11/2011 | Villareal et al. | |
| 8,118,097 | B2 | 2/2012 | Villareal et al. | |
| 2002/0112854 | A1 | 8/2002 | Krueger et al. | |
| 2003/0042021 | A1* | 3/2003 | Bolze et al. | 166/264 |
| 2005/0028974 | A1* | 2/2005 | Moody | 166/264 |
| 2007/0137896 | A1* | 6/2007 | Villareal et al. | 175/59 |
| 2008/0087470 | A1 | 4/2008 | Villareal et al. | |
| 2008/0156486 | A1* | 7/2008 | Ciglenec et al. | 166/264 |
| 2010/0175925 | A1 | 7/2010 | Ciglenec et al. | |
| 2010/0326727 | A1 | 12/2010 | Villareal et al. | |

* cited by examiner

FORMATION SAMPLING

CROSS-REFERENCE TO RELATED APPLICATIONS

This application is a continuation-in-part of, and claims priority to and/or the benefit of the earlier filing date of, each of the following, the entire disclosures of which are hereby incorporated herein by reference:

U.S. Pat. No. 7,367,394, filed Dec. 19, 2005, and issued May 6, 2008;

U.S. Pat. No. 7,594,541, filed Dec. 27, 2006, and issued Sep. 29, 2009;

U.S. patent application Ser. No. 11/942,796, filed Nov. 20, 2007, which is a continuation-in-part of U.S. Pat. No. 7,367,394;

U.S. Pat. No. 7,845,405, filed Jan. 19, 2009, which is a continuation of U.S. patent application Ser. No. 11/942,796;

U.S. patent application Ser. No. 12/366,741, filed Feb. 6, 2009, which is a divisional of U.S. Pat. No. 7,594,541;

U.S. patent application Ser. No. 12/496,950, filed Jul. 2, 2009, which is a continuation of U.S. Pat. No. 7,367,394;

U.S. patent application Ser. No. 12/496,956, filed Jul. 2, 2009, which is a continuation of U.S. Pat. No. 7,367,394;

U.S. patent application Ser. No. 12/496,970, filed Jul. 2, 2009, which is a continuation of U.S. Pat. No. 7,367,394;

U.S. patent application Ser. No. 12/500,725, filed Jul. 10, 2009, which is a continuation of U.S. Pat. No. 7,594,541;

U.S. Provisional Patent App. No. 61/291,967, filed Jan. 4, 2010; and

U.S. Provisional Patent App. No. 61/293,252, filed Jan. 8, 2010.

BACKGROUND OF THE DISCLOSURE

The present disclosure relates to techniques for evaluating a subsurface formation. More particularly, the present disclosure relates to techniques for collecting and/or storing fluid samples acquired from a subsurface formation.

Wellbores are drilled to locate and produce hydrocarbons. A downhole drilling tool with a bit at an end thereof is advanced into the ground to form a wellbore. As the drilling tool is advanced, a drilling mud is pumped from a surface mud pit, through the drilling tool, and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to perform various evaluations of the formations penetrated by the wellbore. In some cases, the drilling tool may be provided with devices to test and/or sample the surrounding formation. In some cases, the drilling tool may be removed and a wireline tool may be deployed into the wellbore to test and/or sample the formation. See, for example, U.S. Pat. Nos. 4,860,581 and 4,936,139. In other cases, the drilling tool may be used to perform the testing and/or sampling. See, for example, U.S. Pat. Nos. 5,233,866; 6,230,557; 7,114,562; and 6,986,282. These samples and/or tests may be used, for example, to locate valuable hydrocarbons.

Formation evaluation often requires that fluid from the formation be drawn into the downhole tool for testing and/or sampling. Various fluid communication devices, such as probes, are typically extended from the downhole tool and placed in contact with the wellbore wall to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall.

Another device used to form a seal with the wellbore sidewall is referred to as a dual packer. With a dual packer, two elastomeric rings expand radially about the tool to isolate a portion of the wellbore therebetween. The rings form a seal with the wellbore wall and permit fluid to be drawn into the isolated portion of the wellbore and into an inlet in the downhole tool.

The mudcake lining the wellbore is often useful in assisting the probe and/or dual packers in making the seal with the wellbore wall. Once the seal is made, fluid from the formation is drawn into the downhole tool through an inlet by lowering the pressure in the downhole tool. Examples of probes and/or packers used in downhole tools are described in U.S. Pat. Nos. 6,301,959; 4,860,581; 4,936,139; 6,585,045; 6,609,568; 6,719,049; and 6,964,301.

In cases where a sample of fluid drawn into the tool is desired, a sample may be collected in one or more sample chambers or bottles positioned in the downhole tool. Examples of such sample chambers and sampling techniques used in wireline tools are described in U.S. Pat. Nos. 6,688,390; 6,659,177; and 5,303,775. Examples of such sample chambers and sampling techniques used in drilling tools are described in U.S. Pat. Nos. 5,233,866 and 7,124,819. Typically, the sample chambers are removable from the downhole tool as shown, for example, in U.S. Pat. Nos. 6,837,314; 4,856,585; and 6,688,390.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
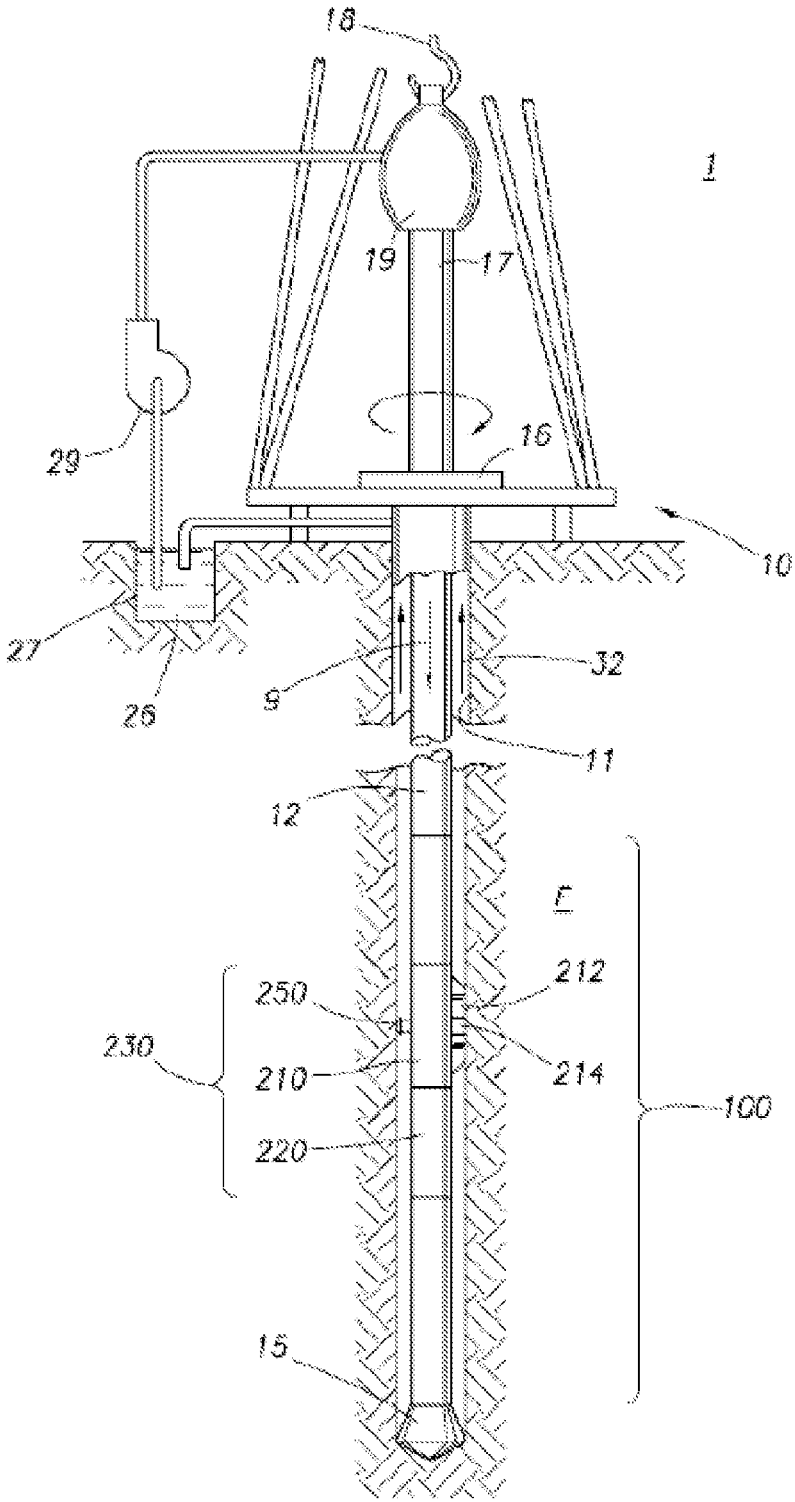
FIG. 1 is a schematic representation of a wellsite having a downhole tool positioned in a wellbore penetrating a subterranean formation, the downhole tool having a sampling while drilling ("SWD") system.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Certain terms are defined throughout this description as they are first used, while certain other terms used in this description are defined below:

"Electrical" and "electrically" refer to connection(s) and/or line(s) for transmitting electronic signals.

"Electronic signals" mean signals that are capable of transmitting electrical power and/or data (e.g., binary data).

"Module" means a section of a downhole tool, particularly a multi-functional or integrated downhole tool having two or more interconnected modules, for performing a separate or discrete function.

"Modular" means adapted for (inter)connecting modules and/or tools, and possibly constructed with standardized units or dimensions for flexibility and variety in use.

"Single phase" refers to a fluid sample stored in a sample chamber, and means that the pressure of the chamber is maintained or controlled to such an extent that sample constituents which are maintained in a solution through pressure only, such as gasses and asphaltenes, should not separate out of solution as the sample cools upon retrieval of the chamber from a wellbore.

FIG. 1 depicts a wellsite 1 including a rig 10 with a downhole tool 100 suspended therefrom and into a wellbore 11 via a drillstring 12. The downhole tool 100 has a drill bit 15 at its lower end thereof that is used to advance the downhole tool into the formation and form the wellbore.

The drillstring 12 is rotated by a rotary table 16, energized by means not shown, which engages a kelly 17 at the upper end of the drillstring. The drillstring 12 is suspended from a hook 18, attached to a traveling block (also not shown), through the kelly 17 and a rotary swivel 19 which permits rotation of the drillstring relative to the hook.

The rig is depicted as a land-based platform and derrick assembly 10 used to form the wellbore 11 by rotary drilling in a manner that is well known. Those of ordinary skill in the art given the benefit of this disclosure will appreciate, however, that aspects of the present disclosure also find application in other downhole applications, such as rotary drilling, and is not limited to land-based rigs.

Drilling fluid or mud 26 is stored in a pit 27 formed at the well site. A pump 29 delivers drilling fluid 26 to the interior of the drillstring 12 via a port in the swivel 19, inducing the drilling fluid to flow downwardly through the drillstring 12 as indicated by a directional arrow 9. The drilling fluid exits the drillstring 12 via ports in the drill bit 15, and then circulates upwardly through the region between the outside of the drillstring and the wall of the wellbore, called the annulus, as indicated by direction arrows 32. In this manner, the drilling fluid lubricates the drill bit 15 and carries formation cuttings up to the surface as it is returned to the pit 27 for recirculation.

The downhole tool 100, sometimes referred to as a bottom hole assembly ("BHA"), may be positioned near the drill bit 15 (in other words, within several drill collar lengths from the drill bit). The bottom hole assembly includes various components with capabilities, such as measuring, processing, and storing information, as well as communicating with the surface. A telemetry device (not shown) may also be provided for communicating with a surface unit (not shown).

The BHA 100 further includes a sampling while drilling ("SWD") system 230 including a fluid communication module 210 and a sample module 220. The modules may be housed in a drill collar for performing various formation evaluation functions (described in detail below). As shown in FIG. 1, the fluid communication module 210 may be positioned adjacent the sample module 220. The fluid communication module is depicted as having a probe with an inlet for receiving formation fluid. Additional devices, such as pumps, gauges, sensor, monitors or other devices usable in downhole sampling and/or testing may also be provided. While FIG. 1 is depicted as having a modular construction with specific components in certain modules, the tool may be unitary or select portions thereof may be modular. The modules and/or the components therein may be positioned in a variety of configurations throughout the downhole tool.

The fluid communication module 210 has a fluid communication device 214, such as a probe, which may be positioned in a stabilizer blade or rib 212. An exemplary fluid communication device that can be used is depicted in U.S. Pat. No. 7,114,562, the entire contents of which are hereby incorporated by reference. The fluid communication device is provided with an inlet for receiving downhole fluids and a flowline (not shown) extending into the downhole tool for passing fluids therethrough. The fluid communication device may be movable between extended and retracted positions for selectively engaging a wall of the wellbore 11 and acquiring a plurality of fluid samples from the formation F. As shown, a back-up piston 250 may be provided to assist in positioning the fluid communication device against the wellbore wall.

Examples of fluid communication devices, such as probes or packers, that can be used, are described in greater detail in U.S. Pat. Nos. 7,114,562 and 5,803,186, the entire disclosures of which are hereby incorporated herein by reference. A variety of fluid communication devices alone or in combination with protuberant devices, such as stabilizer blades or ribs, may be used.

Figure 2A:
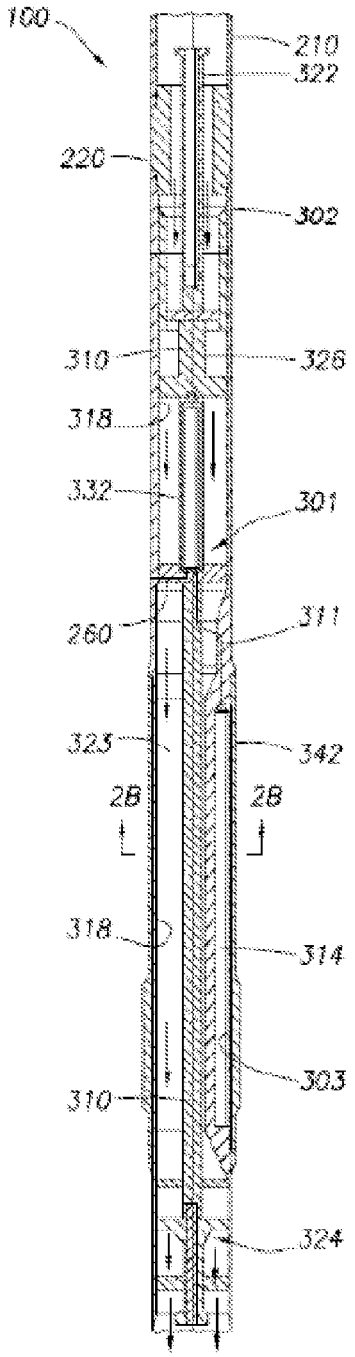
FIG. 2A is a longitudinal cross-sectional representation of a portion of the downhole tool of FIG. 1 depicting a sample module of the SWD system in greater detail, the sample module having a fluid flow system and a plurality of sample chambers therein.
Figure 2B:
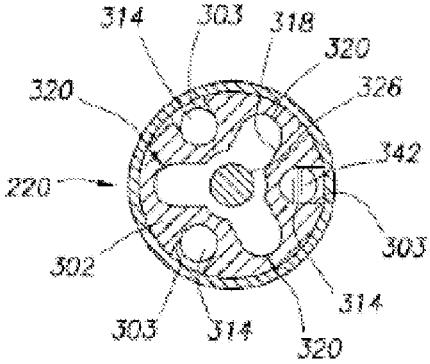
FIG. 2B is a horizontal cross-sectional representation of the sample module of FIG. 2A, taken along section line 2B-2B.

FIGS. 2A and 2B depict a portion of the downhole tool 100 with the sample module 220 of FIG. 1 shown in greater detail.

FIG. 2A is a longitudinal cross-section of a portion of the probe module 210 and the sample module 220. FIG. 2B is a horizontal cross-sectional of the sample module 220 taken along section line 2B-2B of FIG. 2A.

The sample module 220 is housed in a drill collar 302 that is threadably connectable to adjacent drill collars of the BHA, such as the probe module 210 of FIG. 1. The drill collar has a mandrel 326 supported therein. A passage 323 extends between the mandrel and the drill collar to permit the passage of mud therethrough as indicated by the arrows.

The sample chamber, drill collar, and associated components may be made of high strength materials, such as stainless steel alloy, titanium, or inconel. However, the materials may be selected to achieve a desired thermal expansion matching between components. In particular, it may be desirable to use a combination of low cost, high strength, and limited thermal expansion materials, such as PEEK or KEVLAR.

Interface 322 is provided at an end of the module/drill collar to provide hydraulic and/or electrical connections with an adjacent drill collar. An additional interface 324 may be provided at another end to operatively connect to adjacent drill collars if desired. In this manner, fluid and/or signals may be passed between the sample module and other modules as described, for example, in U.S. Pat. No. 7,543,659. In this case, such an interface may be provided to establish fluid communication between the fluid communication module and the sample module to pass formation fluid received by the fluid communication module to the sample module Interface 322 is depicted as being at an uphole end of the sample module 220 for operative connection with adjacent fluid communication module 210. However, it will be appreciated that one or more fluid communication and/or probe modules may be positioned in the downhole tool with one or more interfaces at either or both ends thereof for operative connection with adjacent modules. In some cases one or more intervening modules may be positioned between the fluid communication and probe modules.

The sample module includes a fluid flow system 301 for passing fluid through the drill collar 302. The fluid flow system includes a primary flow line 310 that extends from the interface and into the downhole tool. The flowline may be in fluid communication with the flowline of the fluid communication module via the interface for receiving fluids received thereby. As shown, the flowline is positioned in mandrel 326 and conducts fluid received from the fluid communication module through the sample module.

As shown, the fluid flow system 301 also has a secondary flowline 311 and a dump flowline 260. The secondary flowline diverts fluid from the primary flowline 310 to one or more sample chambers 314 for collection therein. Additional flowlines, such as dump flowline 260 may also be provided to divert flow to the wellbore or other locations in the downhole tool. As shown, a flow diverter 332 is provided to selectively divert fluid to various locations. One or more such diverters may be provided to divert fluid to desired locations.

The sample chambers may be provided with various devices, such as valves, pistons, pressure chambers or other devices to assist in manipulating the capture of fluid and/or maintaining the quality of such fluid. The sample chambers 314 are each adapted for receiving a sample of formation fluid, acquired through the probe 214 (see FIG. 1), via the primary flow line 310 and respective secondary flow lines 311.

As shown, the sample chambers may be removably positioned in an aperture 303 in drill collar 302. A cover 342 may be positioned about the sample chambers and drill collar 302 to retain the sample chambers therein.

As seen in the horizontal cross-section taken along line 2B-2B of FIG. 2A and shown in FIG. 2B, the sample module may be provided with three sample chambers 314. The sample chambers 314 may be evenly spaced apart within the body at 120 degree intervals. However, it will be appreciated that one or more sample chambers in a variety of configurations may be positioned about the drill collar. Additional sample chambers may also be positioned in additional vertical locations about the module and/or downhole tool.

The chambers may be positioned about the periphery of the drill collar 302. As shown, the chambers may be removably positioned in apertures 303 in the drill collar 302. The apertures are configured to receive the sample chambers. The sample chambers may fit in the apertures in a manner that prevents damage when exposed to the harsh wellbore conditions.

A passage 318 extending through the downhole tool may define a plurality of radially-projecting lobes 320. The number of lobes 320 may be equal to the number of sample chambers 314, e.g., three in FIG. 2B. As shown, the lobes 320 project between the sample chambers 314 at a spacing interval of about 60 degrees therefrom. The lobes may expand the dimension of the passage about the sample chambers to permit drilling fluid to pass therethrough.

The lobed bore 318 may be configured to provide adequate flow area for the drilling fluid to be conducted through the drillstring past the sample chambers 314. The chambers and/or containers may be positioned in a balanced configuration that reduces drilling rotation induced wobbling tendencies, reduces erosion of the downhole tool, and/or simplifies manufacturing. Such a configuration may be provided to optimize the mechanical strength of the sample module, while facilitating fluid flow therethrough. The configuration may be adjusted to enhance the operability of the downhole tool and the sampling while drilling system.

Figure 3:
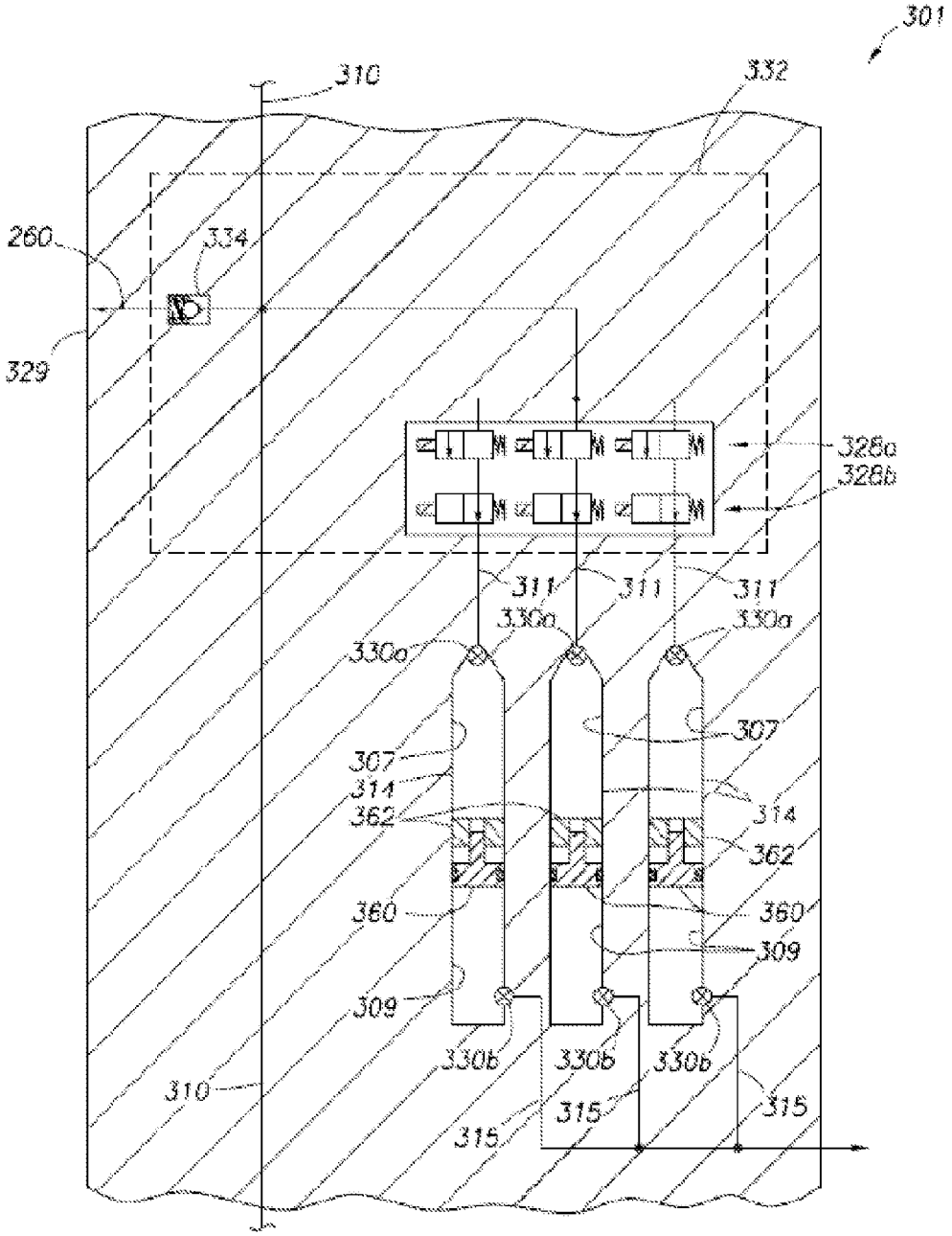
FIG. 3 is a schematic representation of the fluid flow system of FIGS. 2A and 2B.

FIG. 3 is a schematic representation of the fluid flow system 301 of the sample module 220 of FIGS. 2A-2B. As described above, the fluid flow system 301 includes a flow diverter 332 for selectively diverting flow through the sample module and a plurality of sample chambers 314. The flow diverter selectively diverts fluid from primary flowline 310 to secondary flowlines 311 leading to sample chambers 314 and/or a dump flowline 260 leading to the wellbore.

One or more flowlines valves may be provided to selectively divert fluid to desired locations throughout the downhole tool. In some cases, fluid is diverted to one or more sample chambers for collection. In other cases, fluid may be diverted to the wellbore, the passage 318, or other locations as desired.

The secondary flowlines 311 branch off from the primary flowline 310 and extend to corresponding sample chambers 314. The sample chambers may be any type of sample chamber known in the art to capture downhole fluid samples. As shown, the sample chambers may include a slidable piston 360 defining a variable volume sample cavity 307 and a variable volume buffer cavity 309. The sample cavity is adapted to receive and house the fluid sample. The buffer cavity may contain a buffer fluid that applies a pressure to the piston to maintain a pressure differential between the cavities sufficient to maintain the pressure of the sample as it flows into the sample cavity. Additional features, such as pressure compensators, pressure chambers, sensors, and other components, may be used with the sample chambers as desired.

The sample chamber may also be provided with an agitator 362 positioned in the sample chamber. The agitator may be a rotating blade or other mixing device capable of moving the fluid in the sample chamber to retain the quality thereof.

Each sample chamber 314 is shown to have container valves 330*a*, 330*b*. Container valves 330*a* may be provided to selectively fluidly connect the sample cavity of the sample chambers to flowline 311. The chamber valves 330*b* selectively fluidly connect the buffer cavity of the sample chambers to a pressure source, such as the wellbore, a nitrogen charging chamber, or other pressure source.

Each sample chamber 314 is also associated with a set of flowline valves 328*a*, 328*b*, inside a flow diverter/router 332, for controlling the flow of fluid into the sample chamber. One or more of the flowline valves may be selectively activated to permit fluid from flowline 310 to enter the sample cavity of one or more of the sample chambers. A check valve may be employed in one or more flow lines to restrict flow therethrough.

Additional valves may be provided in various locations about the flowline to permit selective fluid communication between locations. For example, a valve 334, such as a relief or check valve, may be provided in a dump flowline 260 to allow selective fluid communication with the wellbore. This permits formation fluid to selectively eject fluid from the flowline 260. This fluid is typically dumped out dump flowline 260 and out the tool body's sidewall 329. Valve 334 may also be open to the wellbore at a given differential pressure setting. Valve 334 may be a relief or seal valve that is controlled passively, actively, or by a preset relief pressure. The relief valve 334 may be used to flush the flowline 310 before sampling and/or to prevent over-pressuring of fluid samples pumped into the respective sample chambers 314. The relief valve may also be used as a safety to prevent trapping high pressure at the surface.

Additional flowlines and valves may also be provided as desired to manipulate the flow of fluid through the tool. For example, a wellbore flowline 315 may be provided to establish fluid communication between buffer cavities 309 and the wellbore. Valves 330*b* permit selective fluid communication with the buffer chambers.

In instances where multiple sample modules 220 are run in a tool string, the respective relief valves 334 may be operated in a selective fashion, such as to be active when the sample chambers of each respective module 220 are being filled. Thus, while fluid samples are routed to a first sample module 220, its corresponding relief valve 334 may be operable. Once all the sample chambers 314 of the first sample module 220 are filled, its relief valve is disabled. The relief valve of an additional sample module may then be enabled to permit flushing of the flow line in the additional sample module prior to sample acquisition (and/or over-pressure protection). The position and activation of such valves may be actuated manually or automatically to achieve the desired operation.

Valves 328*a*, 328*b* may be provided in flowlines 311 to permit selective fluid communication between the primary flowline 310 and the sample cavity 307. These valves may be selectively actuated to open and close the secondary flow lines 311 sequentially or independently.

The valves 328*a*, 328*b* may be electric valves adapted to selectively permit fluid communication. These valves may also be selectively actuated. Such valves may be provided with a spring-loaded stem (not shown) that biases the valves to either an open or closed position. In some cases, the valves may be commercially available exo or seal valves.

To operate the valves, an electric current is applied across the exo washers, causing the washers to fail, which in turn releases the springs to push their respective stems to its other, normal position. Fluid sample storage may therefore be achieved by actuating the (first) valves 328*a* from the displaced closed positions to the normal open positions, which allows fluid samples to enter and fill the sample chambers 314. The collected samples may be sealed by actuating the (second) valves 328*b* from the displaced open positions to the normal closed positions.

The valves may be selectively operated to facilitate the flow of fluid through the flowlines. The valves may also be used to seal fluid in the sample chambers. Once the sample chambers are sealed, they may be removed for testing, evaluation and/or transport. The valves 330*a* may be actuated after the sample module 220 is retrieved from the wellbore to provide physical access by an operator at the surface (valves 330*b* may remain open to expose the backside of the container piston 360 to wellbore fluid pressure). Accordingly, a protective cover (described below) may be equipped with a window for quickly accessing the manually-operable valves, even when the cover is moved to a position closing the sample chamber apertures 313 (FIG. 4).

One or more of the valves may be remotely controlled from the surface by using, for example, standard mud-pulse telemetry, wired drill pipe, and/or other suitable telemetry means. The sample module 220 may be equipped with its own modem and electronics (not shown) for deciphering and executing the telemetry signals. Alternatively, one or more of the valves may be manually activated. Downhole processors may also be provided for such actuation.

Those skilled in the art will appreciate that a variety of valves can be employed within the scope of the present disclosure. Those skilled in the art will also appreciate that alternative sample chamber designs can be used within the scope of the present disclosure. Those skilled in the art will also appreciate that alternative fluid flow system designs can be used within the scope of the present disclosure.

Figure 4A:
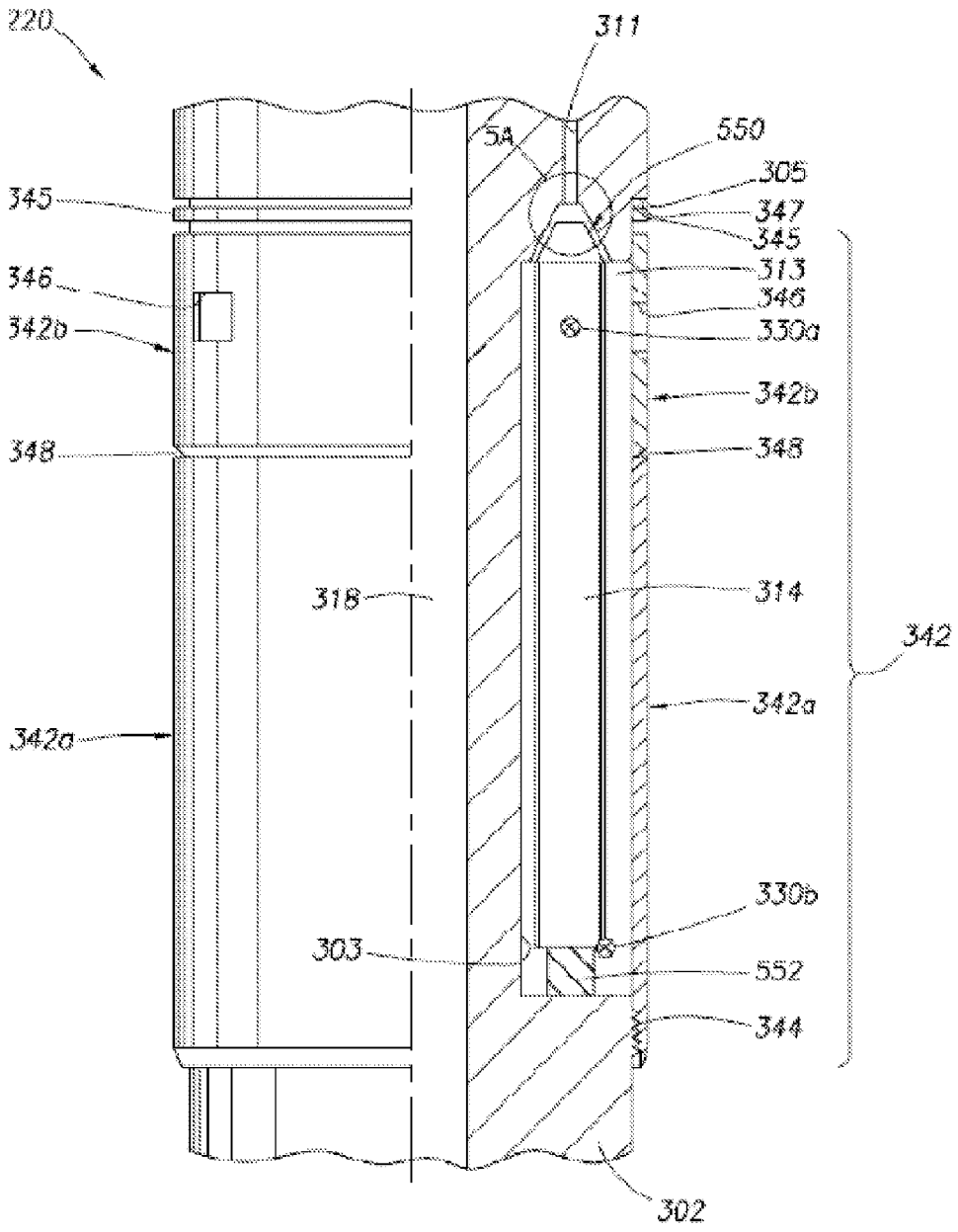
FIG. 4A is a partial sectional representation of the sample module of FIG. 2A having a removable sample chamber retained therein by a two piece cover.
Figure 4B:
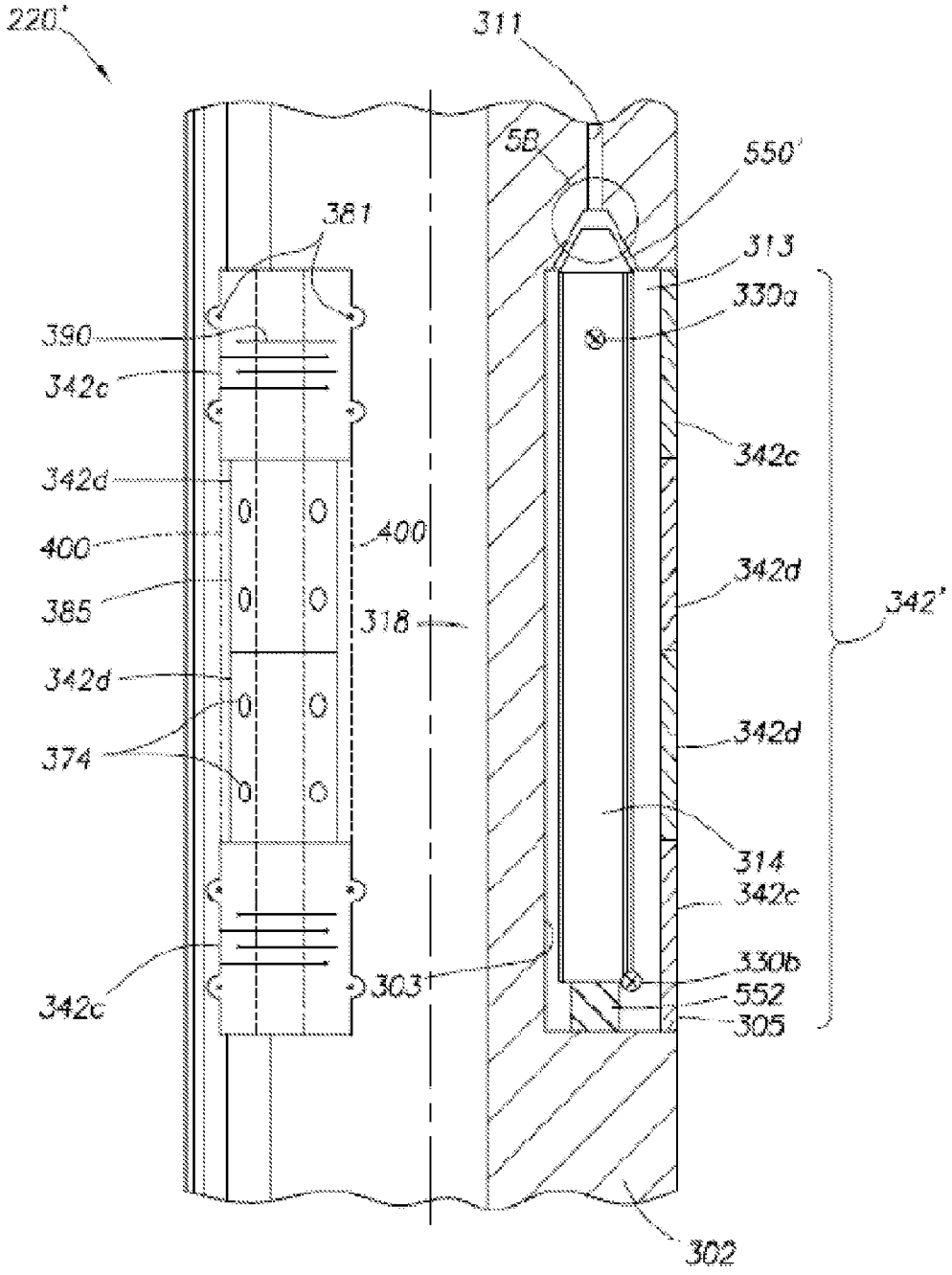
FIG. 4B is a partial sectional representation of an alternate sample module having a removable sample chamber retained therein by a multi-piece cover.

FIGS. 4A and 4B depict options enabling removably positioning sample chambers in the downhole tool. FIG. 4A depicts a sample chamber retained with the downhole tool by a cover, such as a ring or sleeve, slidably positionable about the outer surface of the drill collar to cover one or more openings therein. FIG. 4B depicts a cover, such as a plate or lid, positionable over an opening in the drill collar.

FIG. 4A is a partial sectional representation of the sample module 220, showing a sample chamber 314 retained therein. The sample chamber is positioned in aperture 303 in drill collar 302. The drill collar has a passage 318 for the passage of mud therethrough.

Cover 342 is positioned about the drill collar to retain the sample chamber in the downhole tool. The sample chambers 314 are positioned in the apertures 303 in drill collar 302. Cover 342 may be a ring slidably positionable about drill collar 302 to provide access to the sample chambers 314. Such access permits insertion and withdrawal of sample chamber 314 from the drill collar 302.

The cover 342 acts as a gate in the form of a protective cylindrical cover that may fit closely about a portion of the drill collar 302. The cover 342 is movable between positions closing (see FIG. 4A) and opening (not shown) the one or more apertures 303 in the drill collar. The cover thereby provides selective access to the sample chambers 314. The cover may also prevent the entry of large particles, such as cuttings, from the wellbore into the aperture when in the closed position.

The cover 342 may comprise one or more components that are slidable along the drill collar 302. The cover may have an outer surface adapted to provide mechanical protection from the drilling environment. The cover may also be fitted about the sample chamber to seal the opening(s) and/or secure the sample chamber in position and prevent damage due to harsh conditions, such as shock, external abrasive forces, and vibration.

The cover 342 is operatively connected to the drill collar 302 to provide selective access to the sample chambers. As shown, the cover has a first cover section 342*a* and a second cover section 342*b*. The first cover section 342*a* is held in place about drill collar 302 by connection means, such as engaging threads 344, for operatively connecting an inner surface of the first cover section 342*a* and an outer surface of the drill collar 302.

The cover may be formed as a single piece, or it may include two or more complementing sections. For example, FIG. 4A illustrates a two-piece cover 342 with first and second cover sections 342*a*, 342*b*. Both the first cover section 342*a* and second cover section 342*b* may be slidably positioned about an opening 305 in the tool body 302. The first cover section 342*b* may be slid about the drill collar until it rests upon a downwardly-facing shoulder 347 of the body. A shim 345, or a bellows, spring-washer stack, or other device capable of axial loading of the bottle to secure it in place, may be positioned between the shoulder 347 and the first cover section 342*b*. The second cover section 342*a* may also be slidably positioned about the drill collar 302. The cover sections have complementing stops (referenced as 348) adapted for operative connection therebetween. The second cover section may be operatively connected to the first cover section before or after positioning the covers sections about the drill collar. The first cover section is also threaded onto the drill collar at threaded connection 344.

The cover sections may then be rotated relative to the drill collar 302 to tighten the threaded connection 344 and secure the cover sections in place. The covers may be securably positioned to preload the cover sections and reduce (or eliminate) relative motion between the cover sections and the tool body 302 during drilling.

The cover 342 may be removed from drill collar 302 to access the sample chambers. For example, the cover 342 may be rotated to un-mate the threaded connection 344 to allow access to the sample chamber. The cover 342 may be provided with one or more windows 346. Window 346 of the cover 342 may be used to visually or physically access the sample chamber 314. The window may be used to access valves 330*a*, 330*b* on the sample chamber 314. Window 346 permits the manual valve 330*a* to be accessed at the surface without the need for removing the cover 342. Also, it will be appreciated by those skilled in that art that a windowed cover may be bolted or otherwise operatively connected to the tool body 302 instead of being threadably engaged thereto. One or more such windows and/or covers may be provided about the drill collar to selectively provide access and/or to secure the sample chamber in the drill collar.

The sample chamber may be removably supported in the drill collar. For example, the sample chamber may be supported at an end thereof by a shock absorber 552. An interface 550 is provided at an opposite end adjacent flowline 311 to operatively connect the sample chamber thereto. The interface 550 may also be adapted to releasably secure the sample chamber in the drill collar. The interface and shock absorbers may be used to assist in securing the sample chamber in the tool body. These devices may be used to provide redundant retainer mechanisms for the sample chambers in addition to the cover 342.

FIG. 4B depicts an alternate sample module 220'. The sample module 220' is the same as the sample module 220 of FIG. 4A, except that the sample chamber 314' is retained in drill collar 302 by cover 342', an interface 550', and a shock absorber 552. The cover 342' includes a plurality of cover portions 342*c* and 342*d*.

Cover 342*d* is slidably positionable in opening 305 of the drill collar 302. Cover 342' may be a rectangular plate having an overhang 385 along an edge thereof. The cover may be inserted into the drill collar such that the overhang 385 engages an inner surface 400 of the drill collar. The overhang allows the cover to slidingly engage the inner surface of the drill collar and be retained therein. One or more covers 342*d* are typically configured such that they may be dropped into the opening 305 and slid over the sample chamber 314 (not shown) to the desired position along the chamber cavity opening. The covers may be provided with countersink holes 374 to aid in the removal of the cover 342*d*. The cover 342*d* may be configured with one or more windows, such as the window 346 of FIG. 4A.

Cover 342*c* may be a rectangular plate connectable to drill collar 302 about opening 305. The cover may be removably connected to the drill collar by bolts, screws or other fasteners. The cover may be slidably positionable along the drill collar and secured into place. The cover may be provided with receptacles 381 extending from its sides and having holes therethrough for attaching fasteners therethrough.

The covers as provided herein may be configured with the appropriate width to fit snuggly within the opening 305 of the drill collar. One or more such covers of similar or different configurations may be used. The covers may be provided with devices to prevent damage thereto, such as the strain relief cuts 390 in cover 342 of FIG. 4B. In this manner, the covers may act as shields.

Figure 5B:
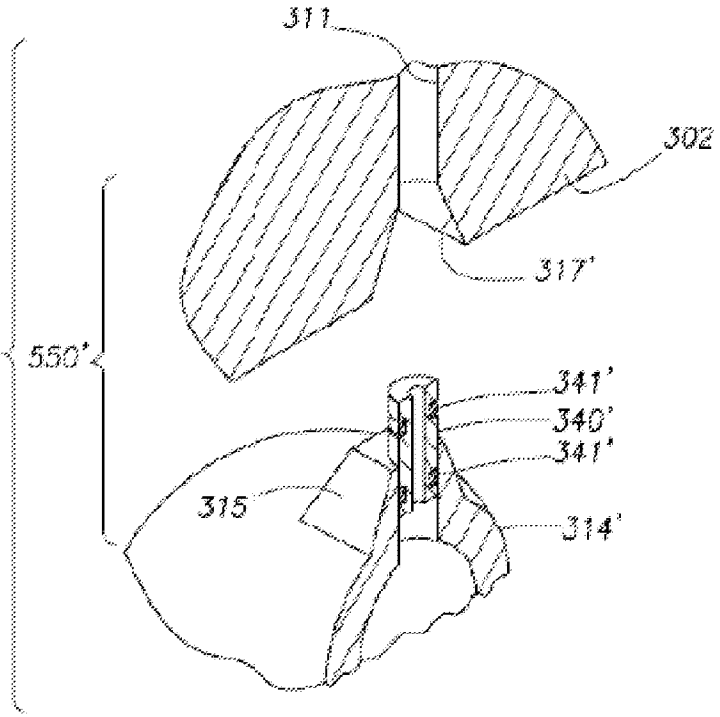
FIG. 5B is an isometric representation, partially in section, of an alternate sample module and interface.
Figure 5A:
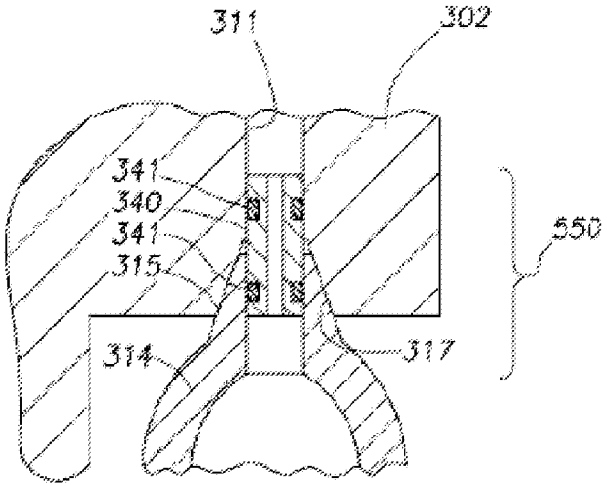
FIG. 5A is a detailed sectional representation of a portion of the sample module of FIG. 4A depicting an interface thereof in greater detail.

FIG. 5A is a detailed representation of a portion of the sample module of FIG. 4A depicting the interface 550 in greater detail. The interface includes a hydraulic stabber 340 fluidly connecting the sample chamber 314 disposed therein to one of the secondary flow lines 311. The sample chamber 314 has a conical neck 315 having an inlet for passing fluids therethrough. The upper portion of the hydraulic stabber 340 is in fluid-sealing engagement with the conical neck 315 of the sample chamber 314, and the lower portion of the hydraulic stabber in fluid-sealing engagement with the secondary flow line 311 of the drill collar 302.

Such retainer mechanisms may be positioned at each of the ends of the sample chambers to releasably retain the sample chamber. A first end of the sample chamber 314 may be laterally fixed, e.g., by sample chamber neck 315. An opposite end typically may also be provided with a retainer mechanism. Alternatively, the opposite end may be held in place by shock absorber 552 (FIG. 4A). These retainer mechanisms may be reversed or various combinations of retainer mechanisms may be used.

The conical neck 315 of the sample chamber 314 is supported in a complementing conical aperture 317 in the tool body 302. This engagement of conical surfaces constitutes a portion of a retainer for the sample chamber. The conical neck may be used to provide lateral support for the sample chamber 314. The conical neck may be used in combination with other mechanisms, such as an axial loading device (described below), to support the sample chamber in place. Little if any forces may be acting on the hydraulic stabber 340 and its O-ring seals 341 to prevent wear of the stabber/seal materials and erosion thereof over time. The absence of forces at the hydraulic seals 341 may equate to minimal, if any, relative motion at the seals 341, thereby reducing the likelihood of leakage past the seals.

FIG. 5B is a detailed view of a portion of the sample module 220' of FIG. 4B with an alternate interface to that of FIG. 4A. The sample chamber 314' of FIG. 5B is equipped with a double-wedge or pyramidal neck 315' that engages a complementing pyramidal aperture 317' in the tool body 302. Hydraulic stabber 340' is positioned in an inlet in pyramidal neck 315' for insertion into pyramidal aperture 317' for fluidly coupling the sample chamber to flowline 311. Hydraulic seals 341' may be provided to fluidly seal the sample chamber to the drill collar.

This pyramidal engagement provides torsional support for the sample chamber, and prevents it from rotating about its axis within the sample chamber. This functionality may be desirable to ensure a proper alignment of manually operated valves 330*a'* and 330*b'* within the opening 313 of the sample chambers 314.

FIGS. 6A-D illustrate a portion of the sample module 220 of FIG. 4A in greater detail. In these figures, the sample module 220 is provided with alternative configurations of retainers 552*a-d* usable as the shock absorbers 552 and/or 552' of FIGS. 4A-4B. These retainers assist in supporting sample chamber 314 within aperture 303 of drill collar 302. Cover 342 also assists in retaining sample chamber 314 in position. The retainer and/or cover may also provide shock absorption and otherwise assist in preventing damage to the sample chamber.

Figure 6B:
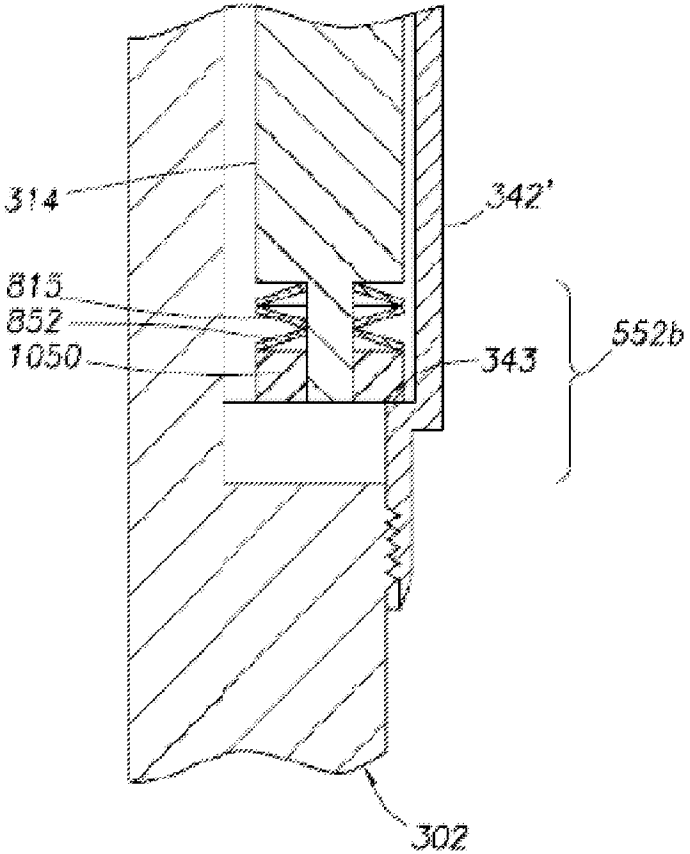
FIGS. 6A-6D are detailed sectional representations of a portion of the sample module of FIG. 4A depicting the shock absorber in greater detail.
Figure 6A:
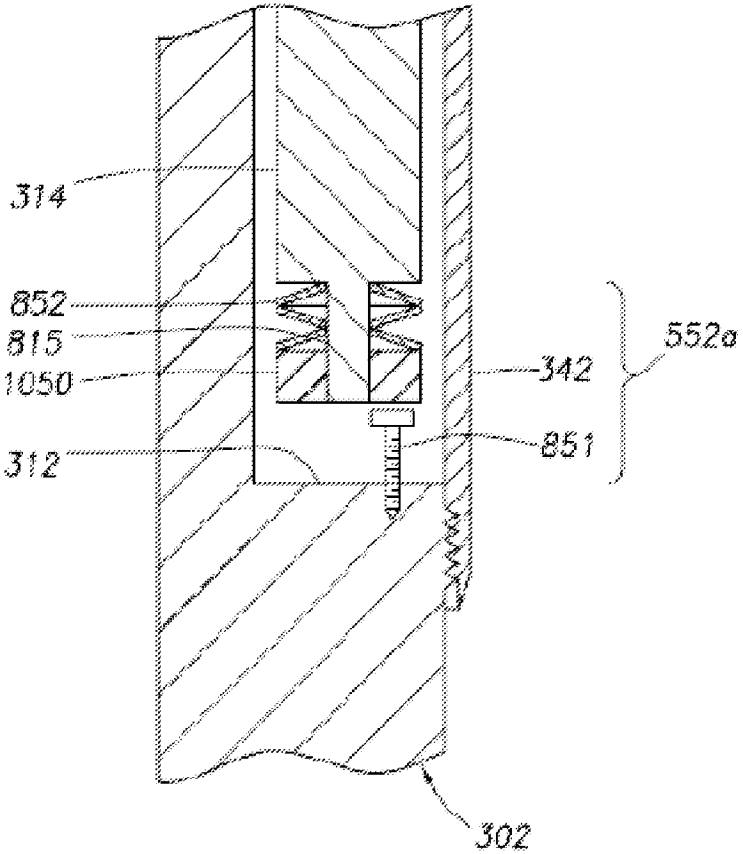

As shown in FIG. 6A, the retainer 552*a* includes an axial-loading device 1050 and a washer 852. An adjustable set-screw 851 is also provided between the drill collar 302 and the retainer 552*a* to adjustably position the sample chamber 314 within the drill collar. The washer may be a belleville stack washer or other spring mechanism to counteract drilling shock, internal pressure in the sample chamber and/or assist in shock absorption.

The sample chamber may have a tip 815 extending from an end thereof. The tip 815 may be provided to support washer 852 and axial loading device 1050 at an end of the sample chamber.

FIG. 6B shows an alternate shock absorber 552*b*. The retainer 552*b* is essentially the same as the retainer 552*a*, but does not have a setscrew 851. In this configuration, support is provided by cover 342'. Cover 342' operates the same as covers 342, but is provided with a stepped inner surface 343. The stepped inner surface defines a cover shoulder 343 adapted to support sample chamber 314 within drill collar 302.

Figure 6D:
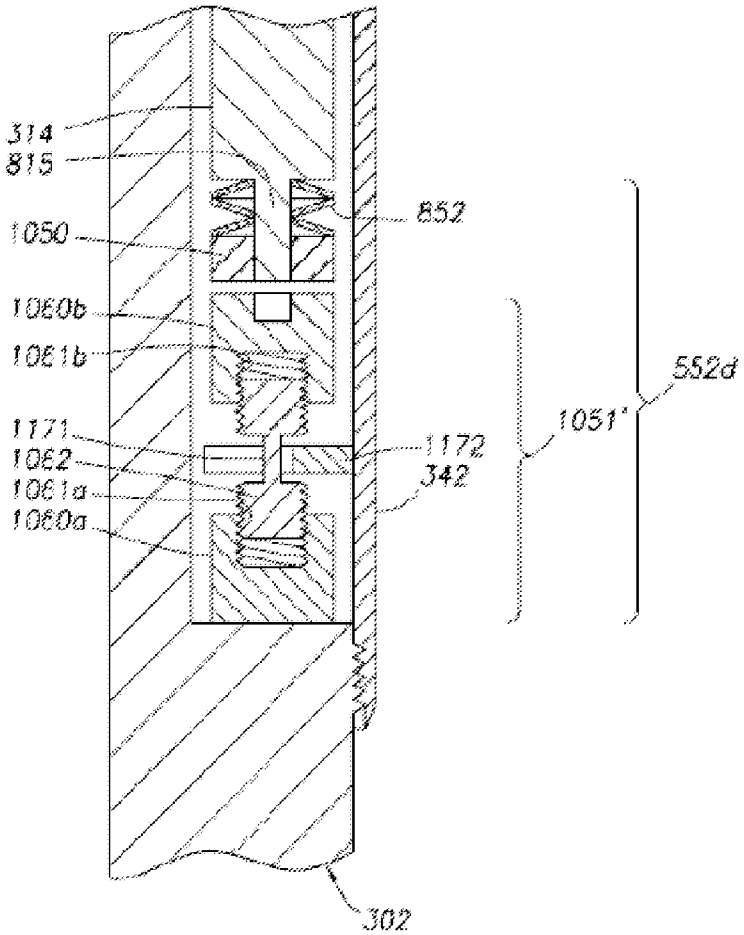
Figure 6C:
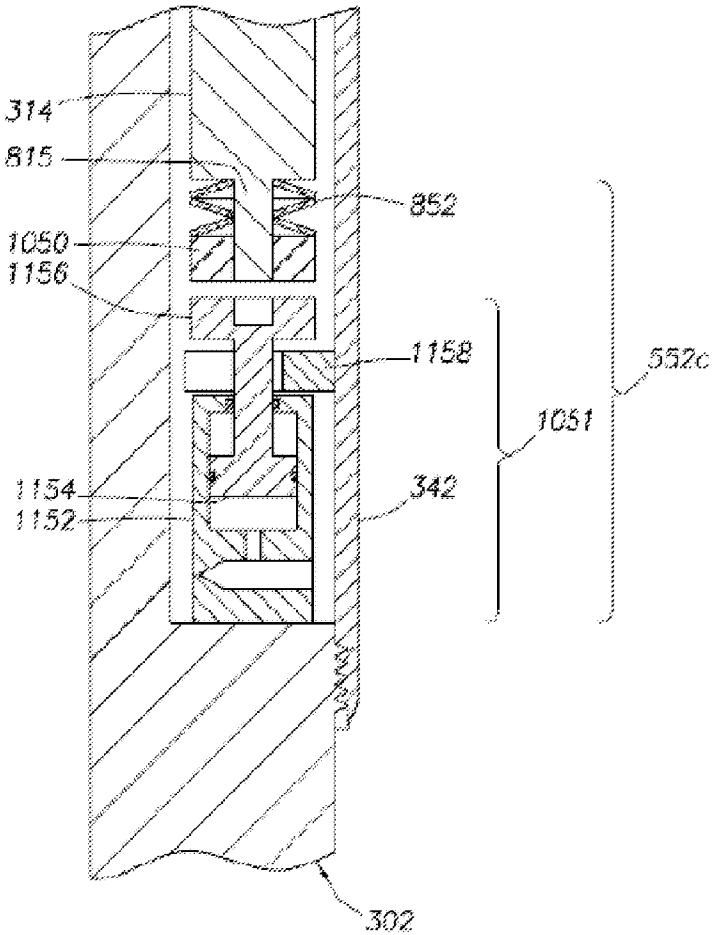

Referring now to FIG. 6C, the shock absorber 552*c* is the same as the shock absorber 552*a* of FIG. 6A, but is further provided with a hydraulic jack 1051. The hydraulic jack includes a hydraulic cylinder 1152, a hydraulic piston 1154, and a hydraulic ram 1156 that are operable to axially load the axial loading spacer 1050.

When the cover 342 is open (not shown), the hydraulic jack may be extended under pressurized hydraulic fluid (e.g., using a surface source) to fully compress the spring member 852. An axial lock (not shown) is then inserted and the pressure in the hydraulic cylinder 1152 may be released. The length of the axial lock may be dimensioned so that the counteracting spring force of the spring member is sufficient in the full temperature and/or pressure range of operation of the sample module, even if the sample module expands more than the sample chamber.

When the cover 342 is retracted (not shown), the hydraulic jack may be extended under pressurized hydraulic fluid (e.g., using a surface source) to fully compress the washer 852. An axial lock 1158 may then be inserted and the pressure in the hydraulic cylinder 1152 released. The length of the axial lock 1158 may be dimensioned so that the counteracting spring force of spring member is sufficient to operate in a variety of wellbore temperatures and pressures.

FIG. 6D depicts an alternate shock absorber 552*d* with an alternate jack 1051'. The shock absorber is the same as the shock absorber 552*c* of FIG. 6C, except that an alternate jack is used. In this configuration, the jack includes opposing lead screws 1060*a* and 1060*b*, rotational lock 1172 and a jack-screw 1062.

The jackscrew 1062 is engaged in opposing lead screws 1060*a* and 1060*b*. Opposing lead screws 1060*a* and 1060*b* are provided with threaded connections 1061*a* and 1061*b* for mating connection with threads on jackscrew 1062. When the cover 342 is open (not shown), the distance between opposing lead screws 1060*a* and 1060*b* may be increased under torque applied to a central, hexagonal link 1171 until a desirable compression of the spring member 852 is achieved. Then a rotation lock 1172 may be inserted around the central, hexagonal link 1171 to prevent further rotation.

Figure 7:
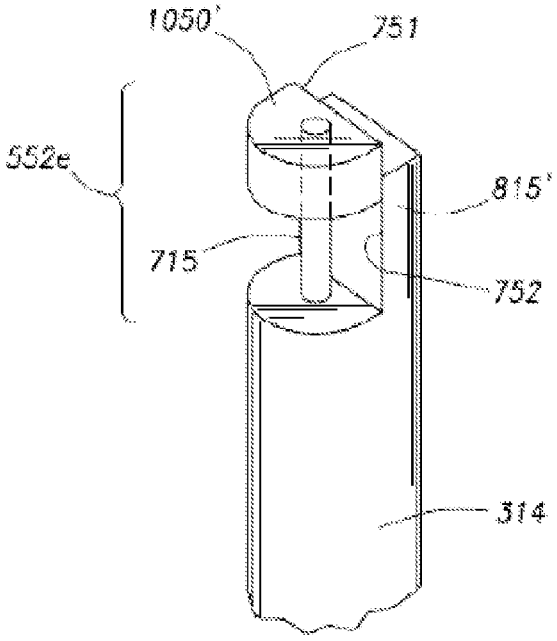
FIG. 7 is an isometric representation of an alternative shock absorber having a retainer usable with the sample module of FIG. 4A.

FIG. 7 illustrates an alternative retainer 552*e* usable as the shock absorber for a sample chamber, such as the one depicted in FIG. 4A. The retainer 552*e* includes an axial-loading spacer 1050' and a head component 715. The axial load spacer may have a flat sidewall 751 for engaging a complementing flat sidewall 752 of an end 815' of the sample chamber 314 and preventing relative rotation therebetween. The head component 715 is insertable into the axial loading spacer 1050' and the sample chamber to provide an operative connection therebetween. A spring member (not shown) may be provided about on a head component 815 of sample chamber 314 between the axial-loading spacer and the sample chamber.

Figure 8A:
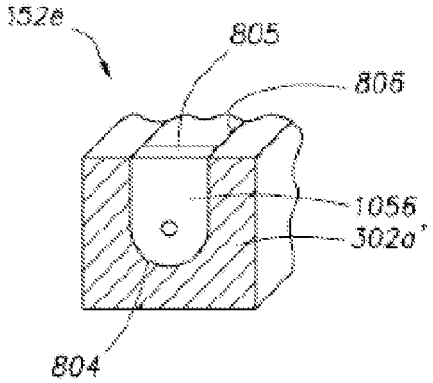
FIG. 8A is an alternate view of the shock absorber of FIG. 7 positioned in a drill collar.
Figure 8B:
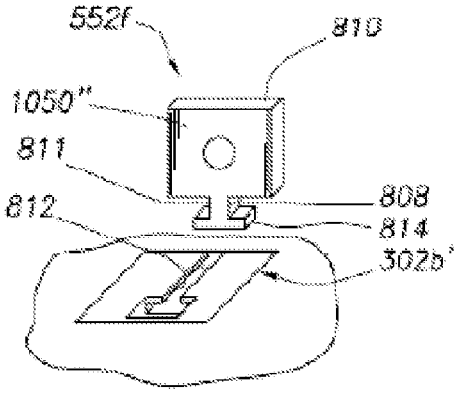
FIG. 8B is an exploded view of an alternate shock absorber and drill collar.
Figure 8C:
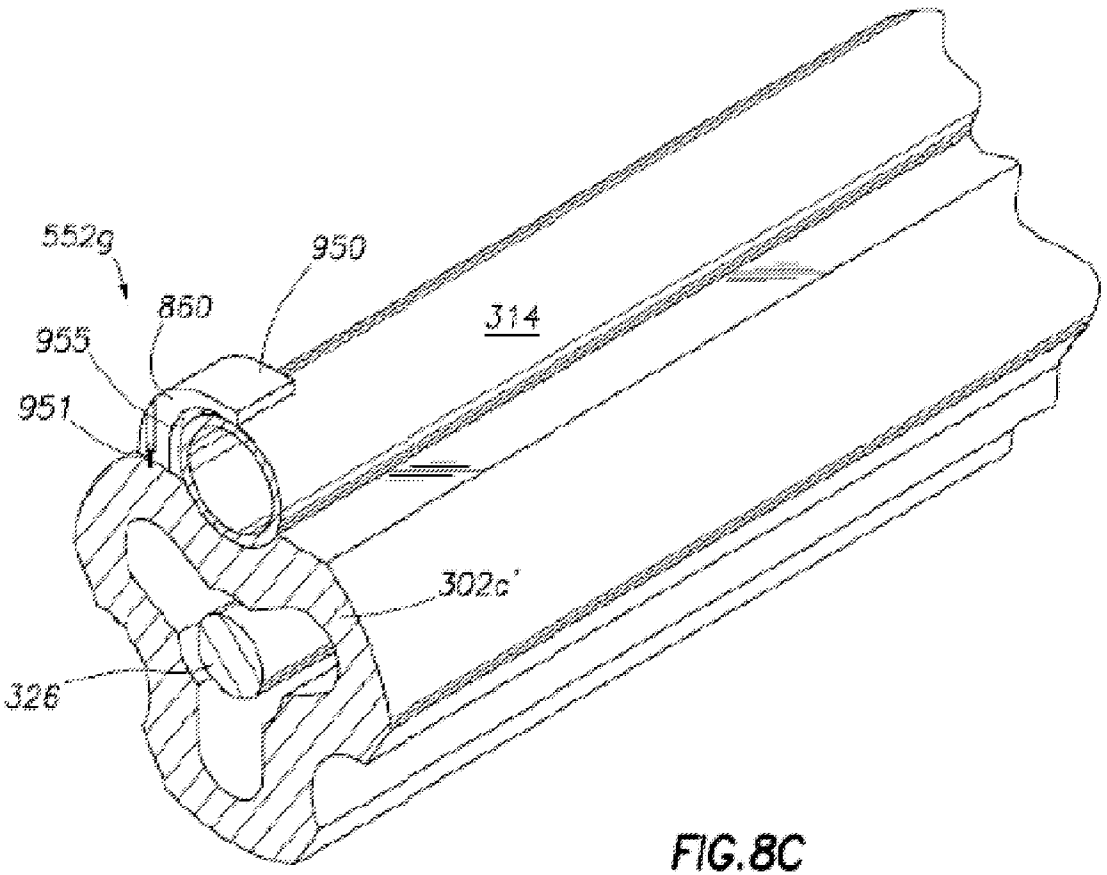
FIG. 8C is an isometric representation, partially in section, of an alternate shock absorber and drill collar.

FIGS. 8A-8C show alternative retainers usable with the sample chamber 314 of FIG. 7. FIG. 8A depicts the retainer 552*e* of FIG. 7 positioned in a drill collar 302*a*. FIG. 8B depicts an alternate retainer 552*f* having an axial-loading spacer 1050" having a key 808 insertable into a drill collar 302*b'*. FIG. 8C depicts an alternate retainer 552*g* having a radial retainer 860 operatively connected to a drill collar 302*c'*. The drill collars of these figures may be the same drill collar 302 as depicted in previous figures, except that they are adapted to receive the respective retainers. These retainers and drill collars may be adapted to prevent rotation and lateral movement therebetween, and/or to provide torsional support.

As shown in FIG. 8A, the axial-loading spacer 1056 of retainer 552*e* has rounded and flat edge portions 804 and 805, respectively. Drill collar 302 has a rounded cavity 806 adapted to receive the axial loading spacer 1056.

In FIG. 8B, the retainer 552*e* includes an axial-loading spacer 1050' having a rectangular periphery 810 and a key 808 extending therefrom. The key 808 may be configured such that it is removably insertable into a cavity 812 in drill collar 302*b'*. As shown, the key has an extension 811 with a tip 814 at an end thereof. The tip 814 is insertable into cavity 812, but resists removal therefrom. The dimension of cavity 812 may be smaller than the tip 814 and provides an inner surface (not shown) that grippingly engages the tip to resist removal. In some cases, it may be necessary to break the tip 814 to enable removal of the sample chamber when desired. Optionally, the tip may be fabricated such that a predetermined force is required to permit removal. In this manner, it is desirable to retain the sample chamber 314 in position in the drill collar during operation, but enable removal when desired.

FIG. 8C the alternative retainer 552*g* includes an arm 950 operatively connected to drill collar 302*c'*. The arm 950 may be connected to drill collar 302*c'* via one or more screws 951. The arm 950 may be radially movable in a hinge like fashion.

The arm 950 has a concave inner surface 955 adapted to engage and retain sample chamber 314 in place in drill collar 302*c'*.

The retainers provided herein may permit selective removal of the sample chambers. One or more such retainers may be used to removably secure the sample chamber in the drill collar. Such retainers may assist in securing the sample chamber in place and prevent shock, vibration or other damaging forces from affecting the sample chamber.

In operation, the sample module is threadedly connected to one or more adjacent drill collars to form the BHA and drill string. The sample module may be pre-assembled by loading the sample chamber 314 into the aperture 303 of the drill collar 302. The interface 550 is created by positioning an end of the sample chamber 314 adjacent the flowline 311.

The interface 550 (also known as a pre-loading mechanism) may be adjusted at the surface such that a minimum acceptable axial or other desirable load is applied to achieve the required container isolation in the expected operating temperature range of the sample module 220, thereby compensating for greater thermal expansion.

Retainer 552 may also be operatively connected to an opposite end of the sample chamber to secure the sample chamber in place. The cover 342 may then be slidably positioned about the sample chamber to secure it in place.

The interface 550 at the (lower) end with the hydraulic connection may be laterally fixed, e.g., by conical engagement surfaces 315, 317 (see, e.g. FIG. 5A) as described above. The retainer 552 at the opposite (upper) end typically constrains axial movement of the sample chamber 314 (see, e.g., FIGS. 6A-8C). The two work together to hold the sample chamber within the drill collar 302. The cover 342 is then disposed about the sample chamber to seal the opening 305 of the sample chamber as shown, for example, in FIG. 4A.

One or more covers, shock absorbers, retainers, sample chambers, drill collars, wet stabbers, and/or other devices may be used alone and/or in combination to provide mechanisms to protect the sample chamber and its contents within the scope of the present disclosure. Redundant mechanisms may be provided to achieve the desired configuration to protect the sample chamber. As shown in FIG. 4, the sample chamber may be inserted into the drill collar 302 and secured in place by interface 550, retainer 552, and cover 342. Various configurations of such components may be used to achieve the desired protection. Additionally, such a configuration may facilitate removal of the sample chamber from the drill collar.

Once the sample module is assembled, the downhole tool is deployed into the wellbore on a drillstring 12 (see FIG. 1). A sampling operation may then be performed by drawing fluid into the downhole tool via the probe module 210 (FIG. 1). Fluid passes from the probe module to the sample module via flowline 310 (FIG. 2A). Fluid may then be diverted to one or more sample chambers via flow diverter 332 (FIG. 3).

Valve 330*b* and/or 330*a* may remain open. In particular, valve 330*b* may remain open to expose the backside of the chamber piston 360 to wellbore fluid pressure. A typical sampling sequence would start with a formation fluid pressure measurement, followed by a pump-out operation combined with in-situ fluid analysis (e.g., using an optical fluid analyzer). Once a certain amount of mud filtrate has been pumped out, genuine formation fluid may be observed as it starts to be produced along with the filtrate. As soon as the ratio of formation fluid versus mud filtrate has reached an acceptable threshold, a decision to collect a sample may be made. Up to this point, however, the liquid pumped from the formation is typically pumped through the probe tool 210 into the wellbore via dump flowline 260. Typically, valves 328 and 335 are closed and valve 334 is open to direct fluid flow out dump flowline 260 and to the wellbore.

After this flushing is achieved, the electrical valves 328*a* may selectively be opened so as to direct fluid samples into the respective sample cavities 307 of sample chambers 314. Typically, valves 334 and 335 are closed and valves 328*a*, 328*b* are opened to direct fluid flow into the sample chamber.

Once a sample chamber 314 is filled as desired the electrical valves 328*b* may be moved to the closed position to fluidly isolate the sample chambers 314 and capture the sample for retrieval to surface. The electrical valves 328*a*, 328*b* may be remotely controlled manually or automatically. The valves may be actuated from the surface using standard mud-pulse telemetry, wired drill pipe, and/or other suitable telemetry means, or may be controlled by a processor (not shown) in the BHA 100.

The downhole tool may then be retrieved from the wellbore 11. Upon retrieval of the sample module 220, the manually-operable valves 330*a*, 330*b* of sample chamber 314 may be closed by opening the cover 342 to (redundantly) isolate the fluid samples therein for safeguarded transport and storage. The closed sample cavities 312 are then opened, and the sample chambers 314 may be removed for transporting to a suitable lab so that testing and evaluation of the samples may be conducted. Upon retrieval, the sample chambers and/or module may be replaced with one or more sample modules and/or chambers and deployed into the wellbore to obtain more samples.

Figure 9:
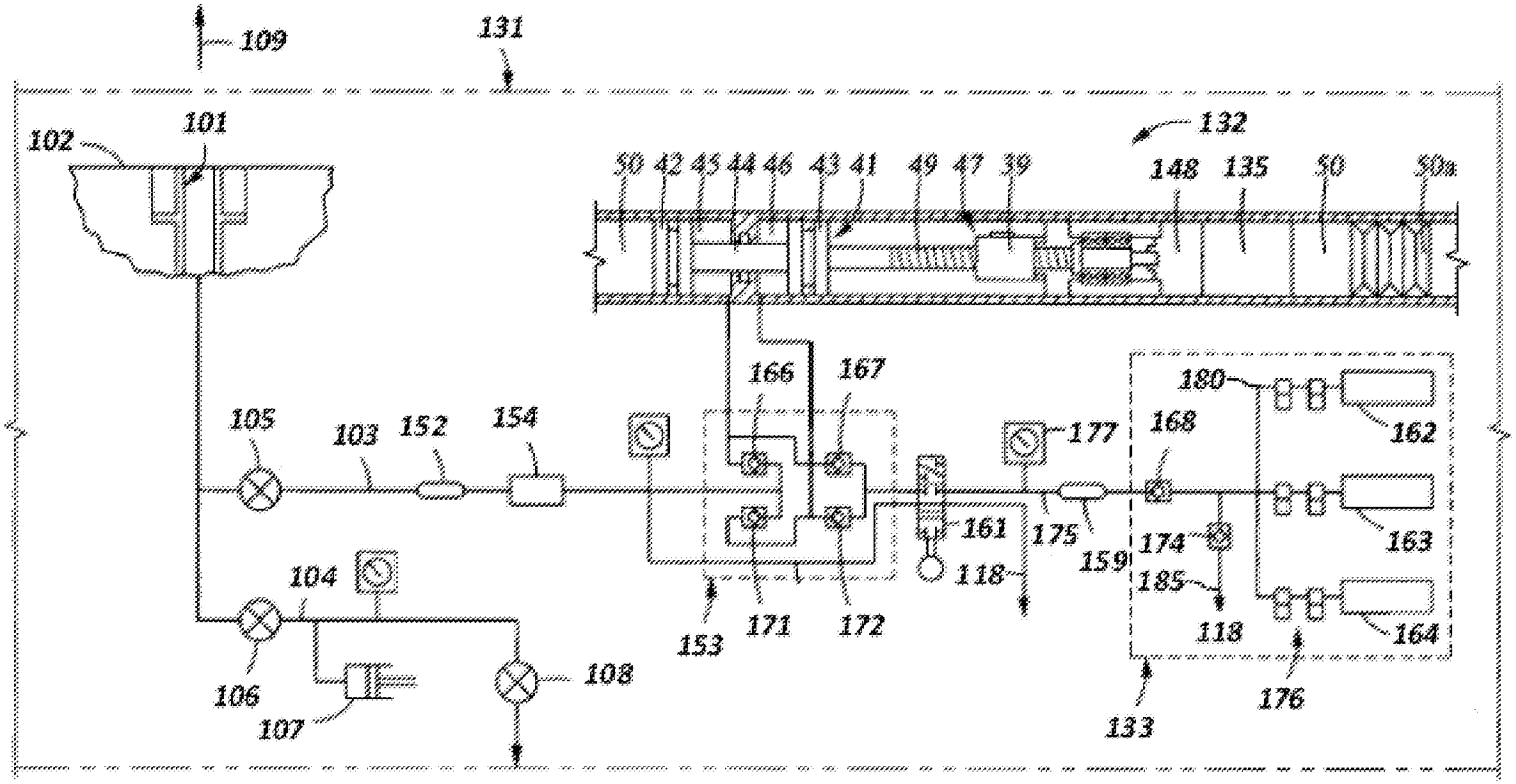
FIG. 9 schematically illustrates a pump for delivering formation fluid from a probe disposed in a tool blade into sample chambers, which are also illustrated.

Turning to FIG. 9, a formation fluid pump and analysis module 132 of a tester tool 131 is disclosed with highly adaptive control features. Various features are used to adjust for changing environmental conditions in-situ. To cover a wide performance range, ample versatility is necessary to run the pump motor 135, together with sophisticated electronics or controller (not shown) and firmware for accurate control.

The formation tester 131 is shown with primary components in one particular arrangement, but other arrangements are obviously possible within the scope of the present disclosure. An extendable hydraulic/electrical connector 152 is used to connect the module 132 to the testing tool 131 and another extendable hydraulic/electrical connector 159 is used to connect the module 132 to the sample collection module 133. Examples of hydraulic connectors suitable for connecting collars can be found for example in U.S. Pat. No. 7,543,659, the entire disclosure of which is hereby incorporated by reference herein.

FIG. 9 also shows a schematic diagram of a probe 101 disposed, for example, in a blade 102 of the tool 131. Two flow lines 103, 104 extend from the probe 101. The flow lines 103, 104 can be independently isolated by manipulating the sampling isolation valve 105 and/or the pretest isolation valve 106. The flow line 103 connects the pump and analyzer tool 132 to the probe 101 in the tester tool 131. The flow line 104 is used for "pretests."

During a pretest, the sampling isolation valve 105 to the tool 131 is closed, the pretest isolation valve 106 to the pretest piston 107 is open, and the equalization valve 108 is closed. The probe 101 is extended toward the formation as indicated by the arrow 109 and, when extended, is hydraulically coupled to the formation (not shown). The pretest piston 107 is retracted in order to lower the pressure in the flow line 104 until the mud cake is breached. The pretest piston 107 is then stopped and the pressure in the flow line 104 increases as it approaches the formation pressure. The formation pressure data can be collected during the pretest. The pretest can be used to determine that the probe 101 and the formation are hydraulically coupled.

The pump 41 may include two pistons 42, 43 connected by a shaft 44 and disposed within corresponding cylinders 45, 46 respectively. The dual piston 42, 43/cylinder 45, 46 arrangement works through positive volume displacement. The piston 42, 43 motion is actuated via the planetary roller-screw 47, which is connected to the electric motor 135 via a gearbox 148. Power to the pump motor 135 is supplied from a dedicated turbine which drives an alternator (not shown). The gearbox or transmission 148 driven by the motor may be used to vary a transmission ratio between the motor shaft and the pump shaft. Alternatively, the combination of the motor 135 and the alternator may be used to accomplish the same objective.

The motor 135 may be part of or integral to the pump 41, but alternatively may be a separate component. The planetary roller screw 47 comprises a nut 39 and a threaded shaft 49. The motor 135 may be a servo motor. The power of the pump 41 may be at least 500 W, which corresponds to about 1 kW at the alternator of the tester tool 131, or at least about 1 kW, which corresponds to at least about 2 kW at the alternator. In lieu of the planetary roller-screw 47 arrangement, other means for fluid displacement may be employed, such as lead screw or a separate hydraulic pump, which would output alternating high-pressure oil that could be used to reciprocate the motion of the piston assembly 42, 43, 44.

During sampling, the downhole formation fluid enters the tool string through the pressure testing tool 131 and is routed to the valve block 153 via the extendable hydraulic/electrical connector 152. Before the fluid reaches the valve block 153, it proceeds from the probe of the pressure tester 131 through the hydraulic/electrical connector 152 and through the analyzer 154. The fluid sample is initially pumped through the fluid identification unit 154. The fluid identification unit 154 comprises an optics module together with other sensors (not shown) and a controller (not shown) to determine fluid composition—oil, water, gas, mud constituents—and properties such as density, viscosity, resistivity, etc.

From the fluid identification unit 154, the fluid enters the fluid displacement unit (FDU) or pump 41 via the set of valves in the valve block 153. The fluid gets routed to either one of the two displacement chambers 45 or 46. The pump 41 operates such that there is always one chamber 45 or 46 drawing fluid in, while the opposite 45 or 46 is expulsing fluid. Depending on the fluid routing and equalization valve 161 setting, the exiting liquid is pumped back to the borehole 118 (or borehole annulus) or through the hydraulic/electrical connector 159 to one of the sample chambers 162, 163, 164, which are located in an adjoining separate drill collar 133. The sample chambers 162-164 may be substantially as described above and shown in the preceding figures. While only three sample chambers 162, 163, 164 are shown, it will be noted that more or less than three chambers 162, 163, 164 may be employed. The number of chambers is not critical, however, and the choice of three chambers constitutes but one possible design within the scope of the present disclosure.

The pumping action of the FDU pistons 42, 43 is achieved via the planetary roller screw 47, nut 39, and threaded shaft 49. The variable speed motor 135 and associated gearbox 148 drives the shaft 49 in a bi-directional mode under the direction of the controller. Gaps between the components are filled with oil 50 and an annulus bellows compensator is shown at 50*a*.

During intake into the chamber 45, fluid passes into the valve block 153 and past the check valve 166 before entering the chamber 45. Upon output from the chamber 45, fluid passes through the check valve 167 to the fluid routing and equalization valve 161 where it is either dumped to the borehole 118 or passed through the hydraulic/electrical connector 159, check valve 168 and into one of the chambers 162-164. Similarly, upon intake into the chamber 46, fluid passes through the check valve 171 and into the chamber 46. Upon output from the chamber 46, fluid passes through the check valve 172, through the fluid routing and equalization valve 161, and to either the borehole 118 or the fluid sample collector module 133.

During a sample collecting operation, fluid gets initially pumped to the module 132 and exits the module 132 via the fluid routing and equalization valve 161 to the borehole 118. This action flushes the flow-line 175 of residual liquid prior to actually filling a sample bottle 162-164 with new or fresh formation fluid. Opening and closing of a bottle 162-164 is performed with sets of dedicated seal valves, shown generally at 176 which are linked to the controller or other device. The pressure sensor 177 is useful, among other things, as a indicative feature for detecting that the sample chambers 162-164 are all full. Relief valve 174 is useful, among other things, as a safety feature to avoid over-pressuring the fluid in the sample chambers 162-164. Relief valve 174 may also be used when fluid needs to be dumped to the borehole 118.

Figure 10:
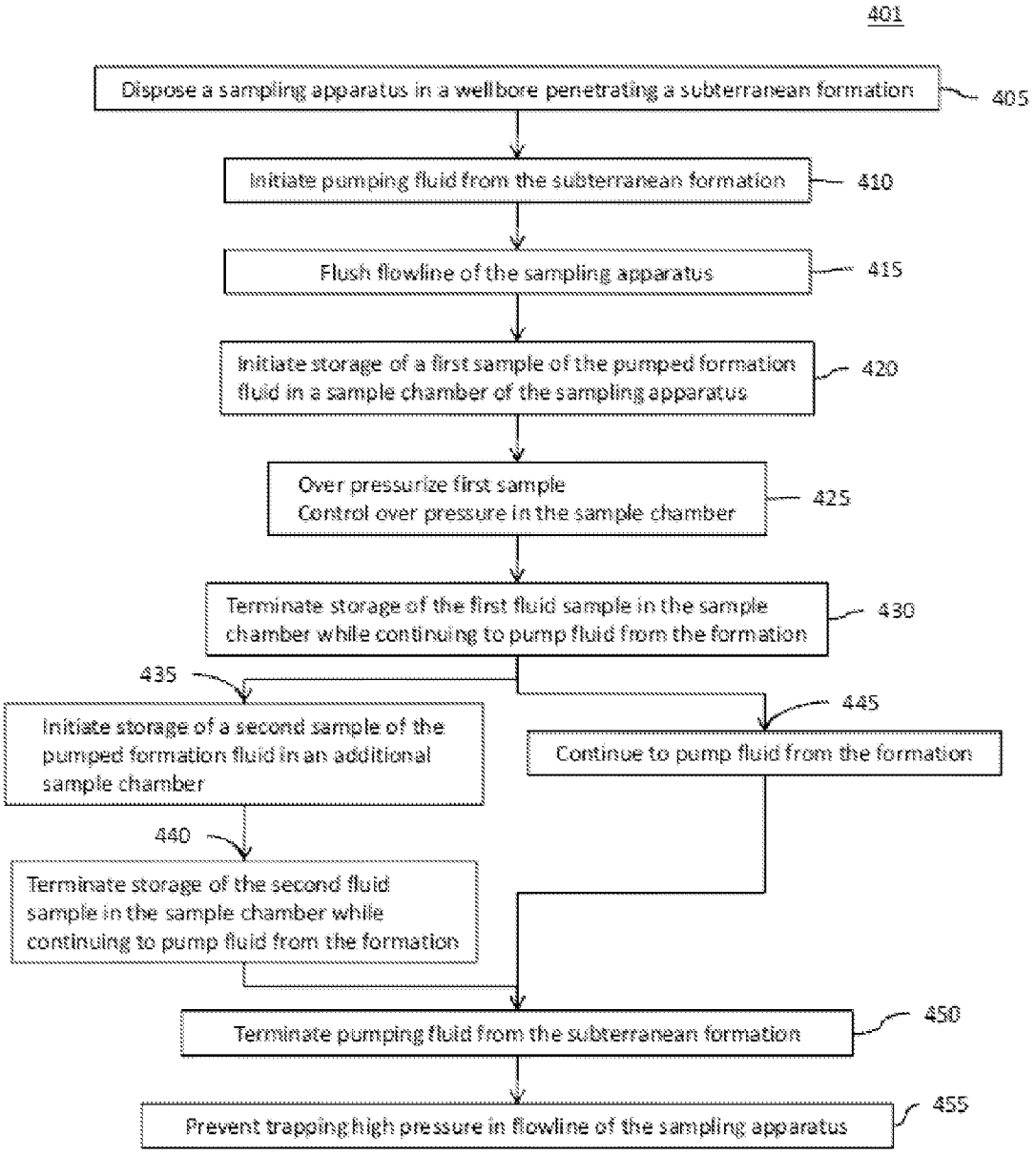
FIG. 10 is a flow-chart diagram of at least a portion of a method according to one or more aspects of the present disclosure.

FIG. 10 shows a flow-chart diagram of at least a portion of a method 401 according to one or more aspects of the present disclosure. The method 401 may be used to acquire samples of fluid from a subterranean formation. The method 401 may be implemented via apparatus shown in the preceding figures and/or otherwise within the scope of the present disclosure.

At step 405, a sampling apparatus may be disposed in a wellbore penetrating a subterranean formation. The sampling apparatus may be of a sampling while drilling type, and/or adapted to be conveyed or disposed in the wellbore using any known or future-developed conveyance means. The sampling apparatus may comprise the sample module 220 shown in FIGS. 2A and/or 2B having the fluid flow system 301 shown in FIG. 3. Alternatively, the sampling apparatus may comprise the tester tool 131 show in FIG. 9. For example, the sampling apparatus may comprise a primary flowline configured to flow fluid from the subterranean formation (e.g., the flowline 310 shown in FIG. 3, the flowline 175 shown in FIG. 9), a secondary flowline configured to divert fluid from the primary flowline to a sample chamber (e.g., the flowline 311 shown in FIG. 3, the flowline 180 shown in FIG. 9), and a dump flowline not provided downstream of the secondary flowline and configured to divert fluid from the primary flowline to the wellbore (e.g., the flowline 260 shown in FIG. 3, the flowline 185 shown in FIG. 9). While the dump flowline is shown provided in the flow system 301 of the sample module 220 in FIG. 3, and/or in the fluid sample collector module 133 in FIG. 9, the dump flowline may alternatively be provided in other locations in the sampling tool within the scope of the present disclosure, such as, for example, in a pump module (e.g., coupled to the valve 161 and on the flow path leading to the wellbore 118 both shown in FIG. 9). A relief valve (e.g., the valve 334 shown in FIG. 3, the valve 174 shown in FIG. 9) may be provided in the dump flowline. The relief valve may be a passive or an active valve. In some cases, the relief valve may also be a normally closed relief check valve which opens or is open at a preset relief pressure. Also, additional dump flow lines and/or relief valves may be provided in other locations in the sampling tool, for example, as shown in U.S. Pat. No. 7,677,307, the entire disclosure of which is hereby incorporated herein by reference.

At step 410, pumping fluid from the subterranean formation may be initiated. For example, fluid may be flowed from the formation into the primary flowline of the sampling apparatus.

At step 415, a flowline (e.g., a portion of the primary flow line) of the sampling apparatus may be flushed using the relief valve. For example, fluid in the flowline may be progressively discharged in the wellbore through the relief valve and replaced by fluid pumped from the formation. A steady fluid flow regime may be established in the primary flowline while monitoring the cleanup using fluid analyzers. As mentioned before, when a plurality of relief valves are used along the primary flowline, some of the plurality of relief valves may be activated while other(s) of the plurality of relief valves may be disabled during flushing. Thus, selected portions of the flowline may be flushed. One benefit of the relief valve may be that, when using a sampling apparatus similar to the tester 131 shown in FIG. 9, the performance of mud check valves (e.g., the mud check valves 166, 167, 171, and/or 172 in FIG. 9) may be improved as they may seat more decisively because of the additional back pressure provided by the relief valve.

At step 420, storage of a first sample of the pumped formation fluid in a sample chamber of the sampling apparatus (e.g., one of the sample chambers 314 shown in FIG. 3, and/or one of the sample chambers 162-164 shown in FIG. 9) may be initiated. For example, when an acceptable contamination level is reached, the fluid flow may be diverted from the primary flowline to the sample chamber through the secondary flowline.

At step 425, the first fluid sample in the sample chamber may be over pressurized using the pump. The fluid in the sample chamber may be pressurized to a pressure at least equal to the pressure in the formation fluid, and/or at least equal to or higher than the pressure in the wellbore fluid. For example, this may be achieved by continuing pumping after a slidable piston of the sample chamber reaches an end of stroke, and/or with a nitrogen charging chamber.

Also at step 425, the pressure in the sample chamber may be controlled using the relief valve. The relief valve may provide a more controllable and consistent pressure in the sample chamber when pressurizing samples relative to that which may otherwise be achieved by stopping the pump. For example, the relief valve may passively or actively open at a preset relief pressure and may permit diverting pumped fluid to the wellbore through the dump flowline. Thus, the relief valve may be used to alleviate the risk of pressurizing the sample of fluid in the sample chamber above the pressure rating of the sample chamber without requiring terminating pumping. A continuous fluid flow from the formation may be maintained during and optionally after the over-pressurization at step 425. Since the fluid flow from the formation may not be disrupted, subsequent samples may be acquired shortly after acquiring an initial sample and/or the formation drawdown may be prolonged until monitoring of formation pressure build-up is initiated, as further described below. Such operation may reduce the time during which the sampling tool is pumping.

At step 230, storage of the first fluid sample in the sample chamber may be terminated while continuing to pump fluid from the formation. For example, the first fluid sample may be sealed in the sample chamber. Fluid pumped from the formation may be discharged in the wellbore through the dump flowline and the relief valve.

At step 235, storage of a second sample of the pumped formation fluid in an additional sample chamber may be initiated. For example, the fluid flow may be diverted from the primary flowline to the additional sample chamber through a flowline similar to the secondary flowline.

At step 440, storage of the second fluid sample in the sample chamber may be terminated while continuing to pump fluid from the formation.

Instead of or in addition to storing a second fluid sample after storing a first fluid sample, pumping fluid from the formation may be continued at step 445. Continuing pumping may be used to prolong an undisrupted drawdown. Such drawdown may be advantageous when performing formation testing and/or to observe a formation build-up after the drawdown.

At step 450, pumping fluid from the subterranean formation may be terminated. The sampling apparatus may then be tripped to the Earth's surface.

At step 455, trapping high pressure in flowline of the sampling apparatus may be prevented. For example, the relief valve may be actively open or may passively open as the pressure in the wellbore diminishes, therefore releasing the pressure in the primary flowline.

Figure 11:
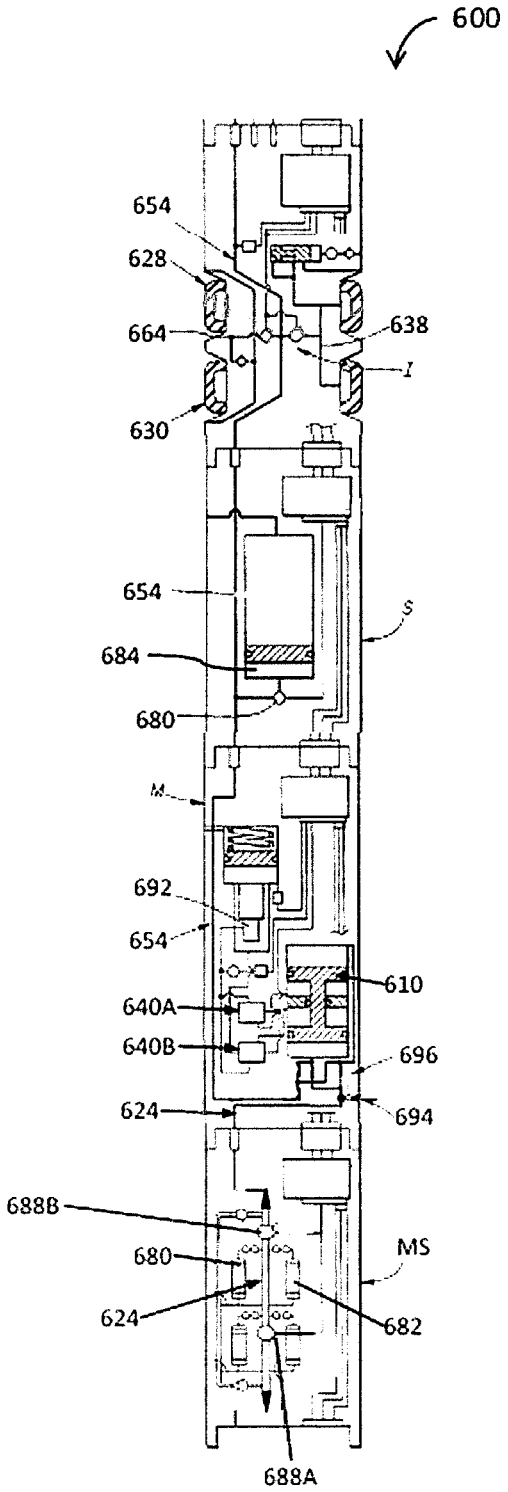
FIG. 11 is a schematic view of apparatus according to one or more aspects of the present disclosure.

FIG. 11 shows a schematic a formation tester 600 of a type that may be disposed in a wellbore penetrating a formation at the end of a wireline cable. As shown, the formation tester 600 is of modular type, and may comprise a straddle packer module I, a sample chamber module S, a pump module M, and a multi-sample module MS.

The pump module M may comprise a hydraulic pump 692. The hydraulic pump 692 may be used to flow hydraulic oil to hydraulic control networks 640A and 640B. The hydraulic control networks 640A and 640B may be configured to reciprocate a piston assembly 610. The pump module M may be configured to pump downhole fluid in an upward direction, that is, from the flowline 624 to the flowline 654, as well as in a downward direction, that is, from the flowline 654 to the flowline 624. This may be exerted by switching the checking direction of the mud check valves in the valve block 696, for example as taught in U.S. Pat. No. 7,302,966, incorporated herein by reference. However, the operation of the pump module may be limited to pump fluid from a source at a first pressure to a receiver at a second pressure, wherein the first pressure is no lower than the second pressure minus the cracking pressure of the mud check valves in the valve block 696.

The formation tester 600 may be used, for example, to perform testing of mechanical strength properties of the formation, also referred to as stress testing. In stress testing, the straddle packer module I may be used to isolate an interval of the formation wall by inflating the packers 628 and 630 via the flowline 638. The pump module M may be used to pump fluid (e.g., wellbore fluid) in an upward direction through the flowline 654, through the exit port 664 and into the isolated interval until the formation cracks. Pressure in the isolated interval may be measured using a pressure sensor. Pumped fluid volume and/or flowrate of the fluid pumped into the interval may also be measured by the pump module M, as is well known in the art.

In some cases, it may be advantageous to drain the fluid in the downward direction from the sealed interval and into the flowline 654 in a controlled manner. For example, volume and/or flowrate should be measured when the fluid is drained. Together with the measured pressure response, the volume and/or flowrate may be used in interpretation of the mechanical properties of the formation, as is well known in the art.

To controllably drain the fluid in the downward direction and/or measure the drained fluid volume and/or flowrate with the pump module M, the pump module M also comprises a relief valve 694 in fluid communication between the top of the flow line 624 and the outer surface of the tester 600 (and therefore in fluid communication with a wellbore when the tester is positioned in the wellbore). The relief valve 694 may be of a type similar to the relief valve 334 shown in FIG. 3 and/or the relief valve 174 shown in FIG. 9. By closing the seal valve 688B, the relief valve 694 may be used to increase the pressure in the flowline 624 to a level essentially higher than the pressure in the sealed interval and in the flowline 654. Thus, the pump module M can be used for controlled relief of pressure from the sealed interval with volume and/or flowrate measurement capability.

The sample chamber module S may be used, for example, to store "clean" water or base oil 684 before running in the wellbore when operating in respectively water or oil based mud. The "clean" water or base oil 684 may be used in situ to clean solids from the drilling mud that may have unintentionally settled on the ball seats of the mud check valves in the valve block 696. For example, once the seal valve 680 is open, the pump module M may be actuated to flow clean fluid 696 through the pump module M and discharge the clean fluid 696 at an exit port provided by the relief valve 694.

The formation tester 600 may also be used to initiate pumping fluid from a subterranean formation, for example through a formation interval sealed with the packer module I and via the pump module M, to initiate storage of a sample of the pumped formation fluid in a sample chamber 680 by closing the seal valve 688A, and to terminate storage of the fluid sample in the sample chamber 688A while continuing to pump fluid from the formation with the pump module M when the pressure in the flow line 624 is such that the relief valve 694 opens to the wellbore. The formation tester 600 may also be used to continue pumping fluid from the formation after terminating storage of the fluid sample in the sample chamber 680, by discharging the pumped fluid in the wellbore at the relief valve 694. The storage of another sample of the pumped formation fluid may then be initiated in the sample chamber 682.

In view of all of the above and FIGS. 1 to 11, it should be readily apparent to those skilled in the art that the present disclosure provides an apparatus comprising a primary flowline configured to flow fluid from a subterranean formation penetrated by a wellbore and into the apparatus, a secondary flowline configured to divert fluid from the primary flowline to a sample chamber; a dump flowline not provided downstream of the secondary flowline and configured to divert fluid from the primary flowline to the wellbore, and a relief valve provided in the dump flowline. An opening of the relief valve may be controlled by a preset relief pressure. The relief valve may be a passive relief valve. The relief valve may be an active relief valve. The relief valve may comprise a relief check valve. The sample chamber may comprise a slidable piston defining a variable sample volume and a variable buffer volume. The apparatus may further comprise a wellbore flowline configured to establish fluid communication between the buffer volume and the wellbore. The apparatus may further comprise a nitrogen charging chamber in fluid communication with the buffer volume. The apparatus may further comprise a fluid routing valve disposed on the primary flowline and configured to selectively discharge the fluid from the primary flowline to the wellbore. The apparatus may further comprise a pump in fluid communication between an inlet of the primary flowline and the dump flowline.

The present disclosure also provides a method comprising disposing an apparatus in a wellbore penetrating a subterranean formation, the apparatus comprising a primary flowline, a secondary flowline, a dump flowline, and a relief valve provided in the dump flowline, flowing fluid from the subterranean formation and into the primary flowline, diverting fluid from the primary flowline to a sample chamber through the secondary flowline, diverting fluid from the primary flowline to the wellbore through the dump flowline, and controlling the pressure in the sample chamber using the relief valve. The method may further comprise preventing trapping high pressure in the primary flowline using the relief valve. The method may further comprise flushing a portion of the primary flowline using the relief valve before diverting fluid from the primary flowline to the sample chamber. Controlling the pressure in the sample chamber using the relief valve may comprise opening the dump flowline to the wellbore at a preset relief pressure. Controlling the pressure in the sample chamber using the relief valve may comprise actively opening the relief valve. Controlling the pressure in the sample chamber using the relief valve may comprise passively opening the relief valve. Flowing fluid from the subterranean formation may comprise actuating a pump in fluid communication between an inlet of the primary flowline and the dump flowline.

The present disclosure also provides a method comprising initiating pumping fluid from a subterranean formation using a downhole tool positioned in a wellbore penetrating the formation; initiating storage of a sample of the pumped formation fluid in a sample chamber of the downhole tool; and terminating storage of the fluid sample in the sample chamber while continuing to pump fluid from the formation. The method may further comprise continuing to pump fluid from the formation after terminating storage of the fluid sample in the sample chamber. The fluid sample may be a first fluid sample, and the method may further comprise initiating storage of a second sample of the pumped formation fluid in an additional sample chamber of the downhole tool after terminating storage of the first fluid sample.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A downhole tool, comprising:

a primary flowline extending within the downhole tool to direct fluid from a subterranean formation through the downhole tool;

a secondary flowline in fluid communication with the primary flowline to divert the fluid from the primary flowline to a sample chamber disposed in a sample chamber module of the downhole tool;

a dump flowline disposed in a pump module of the downhole tool and in fluid communication with the primary flowline to divert the fluid from the primary flowline to the wellbore upstream of the secondary flowline; and a relief valve disposed in the pump module and in the dump flowline to control a pressure of the sample chamber.

2. The downhole tool of claim 1 wherein an opening of the relief valve is controlled by a preset relief pressure.

3. The downhole tool of claim 1 wherein the relief valve is a passive relief valve.

4. The downhole tool of claim 1 wherein the relief valve is an active relief valve.

5. The downhole tool of claim 1 wherein the relief valve comprises a relief check valve.

6. The downhole tool of claim 1 wherein the sample chamber comprises a slidable piston defining a variable sample volume and a variable buffer volume.

7. The downhole tool of claim 6 further comprising a wellbore flowline configured to establish fluid communication between the buffer volume and the wellbore.

8. The downhole tool of claim 1 further comprising an equalization valve disposed on the primary flowline upstream of the dump flowline to selectively discharge the fluid from the primary flowline to the wellbore.

9. The downhole tool of claim 1 further comprising valve system disposed on the primary flowline to direct the fluid through a pump.

10. A method, comprising:

disposing a downhole tool in a wellbore penetrating a subterranean formation, the downhole tool comprising a primary flowline, a secondary flowline, a dump flowline disposed in a pump module of the downhole tool, and a relief valve disposed in the pump module and in the dump flowline;

flowing fluid from the subterranean formation and into the primary flowline;

diverting fluid from the primary flowline through the secondary flowline to a sample chamber disposed in a sample chamber module of the downhole tool;

diverting fluid from the primary flowline, upstream of the secondary flowline, through the dump flowline to the wellbore; and controlling a pressure in the sample chamber using the relief valve.

11. The method of claim 10 further comprising preventing trapping high pressure in the primary flowline using the relief valve.

12. The method of claim 10 further comprising flushing a portion of the primary flowline using the relief valve before diverting fluid from the primary flowline to the sample chamber.

13. The method of claim 10 wherein controlling the pressure in the sample chamber using the relief valve comprises opening the dump flowline to the wellbore at a preset relief pressure.

14. The method of claim 10 wherein controlling the pressure in the sample chamber using the relief valve comprises actively opening the relief valve.

15. The method of claim 10 wherein controlling the pressure in the sample chamber using the relief valve comprises passively opening the relief valve.

16. The method of claim 10 wherein flowing fluid from the subterranean formation comprises actuating a pump in fluid communication between an inlet of the primary flowline and the dump flowline.

* * * * *